US008923716B2

(12) United States Patent
Nakamura et al.

(10) Patent No.: US 8,923,716 B2
(45) Date of Patent: Dec. 30, 2014

(54) TRANSFER DEVICE, IMAGE FORMING APPARATUS, AND TRANSFER METHOD

(75) Inventors: Keigo Nakamura, Kanagawa (JP); Haruo Iimura, Kanagawa (JP); Shinji Aoki, Kanagawa (JP); Yasuhiko Ogino, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 300 days.

(21) Appl. No.: 13/208,673

(22) Filed: Aug. 12, 2011

(65) Prior Publication Data

US 2012/0045259 A1 Feb. 23, 2012

(30) Foreign Application Priority Data

Aug. 18, 2010 (JP) ..... 2010-183301
Jun. 20, 2011 (JP) ..... 2011-135975

(51) Int. Cl.
*G03G 15/16* (2006.01)

(52) U.S. Cl.
CPC .... *G03G 15/1605* (2013.01); *G03G 2215/0129* (2013.01)
USPC ..... 399/66; 399/55; 399/121; 399/279

(58) Field of Classification Search
USPC ..... 399/66, 55, 121, 154, 297
See application file for complete search history.

(56) References Cited

U.S. PATENT DOCUMENTS 3,860,857 A 1/1975 Namiki et al.
5,595,852 A 1/1997 Shimoda et al.
5,713,063 A 1/1998 Oono
6,284,424 B1 9/2001 Iimura et al.
7,662,530 B2 2/2010 Iimura
2007/0178398 A1 8/2007 Ogino et al.
2008/0187857 A1 8/2008 Ogino et al.
2009/0123168 A1 5/2009 Aoki et al.
2009/0136272 A1 5/2009 Whitney et al.
2009/0142087 A1 6/2009 Iimura
2010/0098446 A1 4/2010 Ishikawa et al.
2010/0226697 A1 9/2010 Ogino (Continued)

FOREIGN PATENT DOCUMENTS

JP 1-229277 9/1989
JP 2-300774 12/1990

(Continued)

OTHER PUBLICATIONS

U.S. Appl. No. 13/206,957, filed Aug. 10, 2011, Ogino, et al.

(Continued)

*Primary Examiner* — Walter L Lindsay, Jr.
*Assistant Examiner* — Roy Y Yi
(74) *Attorney, Agent, or Firm* — Oblon, Spivak, McClelland, Maier & Neustadt, L.L.P.

(57) ABSTRACT

A transfer device includes an image carrier that carries a toner image; a nip forming member that forms a transfer nip between the nip forming member and the image carrier by contacting with a front surface of the image carrier; and a transfer bias applying unit that applies a transfer bias, thereby transferring the toner image carried on the image carrier to a recording material at a position of the transfer nip. The transfer bias applying unit applies the transfer bias in which an AC component and a DC component are superimposed and in which a peak-to-peak voltage of the AC component is larger than 6 times an absolute value of a voltage of the DC component.

34 Claims, 10 Drawing Sheets

(56) References Cited

U.S. PATENT DOCUMENTS

| | | | | |
|---|---|---|---|---|
| 2010/0232820 | A1 | 9/2010 | Usami et al. | |
| 2010/0284705 | A1 | 11/2010 | Aoki et al. | |
| 2011/0058831 | A1 | 3/2011 | Usami et al. | |
| 2011/0200348 | A1 | 8/2011 | Aoki | |
| 2011/0229168 | A1 | 9/2011 | Shiraishi et al. | |
| 2011/0255892 | A1 | 10/2011 | Aoki | |
| 2013/0064559 | A1 * | 3/2013 | Nakamura et al. | 399/44 |

FOREIGN PATENT DOCUMENTS

| | | |
|---|---|---|
| JP | 4-86878 | 3/1992 |
| JP | 9-146381 | 6/1997 |
| JP | 2004-258397 | 9/2004 |
| JP | 2006-267486 | 10/2006 |
| JP | 2007-304492 | 11/2007 |
| JP | 2008-58585 | 3/2008 |
| JP | 2010-30239 | 2/2010 |
| JP | 2010-58660 | 3/2010 |
| JP | 2010-94790 | 4/2010 |

OTHER PUBLICATIONS

Extended Search Report issued Dec. 19, 2011 in European Patent Application No. 11176959.2-2209.

* cited by examiner

ONLY DC VOLTAGE

DC VOLTAGE AND AC VOLTAGE

Voff=-2.0 kV, Vpp=0 kV

Voff=-2.0 kV, Vpp=4.0 kV

Voff=-2.0 kV, Vpp=8.0 kV

| | LEA-THAK 66 260 kg | LEA-THAK 66 215 kg | LEA-THAK 66 175 kg | LEA-THAK 66 130 kg | LEA-THAK 66 100 kg | SAZA-NAMI | MY PAPER |
|---|---|---|---|---|---|---|---|
| MAXIMUM DEPTH OF ROUGHNESS [μm] | 162.60 | 137.82 | 104.64 | 103.79 | 89.46 | 81.76 | 29.26 |
| SHEET THICKNESS [μm] | 324 | 273 | 228 | 184 | 144 | 132 | 90 |

TRANSFER DEVICE, IMAGE FORMING APPARATUS, AND TRANSFER METHOD

CROSS-REFERENCE TO RELATED APPLICATIONS

The present application claims priority to and incorporates by reference the entire contents of Japanese Patent Application No. 2010-183301 filed in Japan on Aug. 18, 2010 and Japanese Patent Application No. 2011-135975 filed in Japan on Jun. 20, 2011.

BACKGROUND OF THE INVENTION

1. Field of the Invention

The present invention relates to a transfer device for and a transfer method of transferring a toner image carried on a surface of an image carrier to a recording sheet. The present invention relates further to an image forming apparatus using the transfer device and the transfer method.

2. Description of the Related Art

Japanese Patent Application Laid-open No. 2006-267486 discloses an image forming apparatus of this kind. This image forming apparatus forms a toner image on a surface of a drum-shaped photosensitive element by a known electrophotography process. An endless intermediate transfer belt serving as an image carrier is brought into contact with the photosensitive element, whereby a primary transfer nip is formed. In the primary transfer nip, the toner image on the photosensitive element is primarily transferred to the intermediate transfer belt. A secondary transfer roller serving as a nip forming member is brought into contact with the intermediate transfer belt, whereby a secondary transfer nip is formed. Inside a loop of the intermediate transfer belt, a secondary-transfer counter roller is disposed such that the intermediate transfer belt is interposed between the secondary-transfer counter roller and the secondary transfer roller. The secondary-transfer counter roller disposed inside the loop is grounded, while the secondary transfer roller disposed outside the loop is applied with a secondary transfer bias. This creates a secondary transfer electric field between the secondary-transfer counter roller and the secondary transfer roller, which moves electrostatically the toner image from the secondary-transfer counter roller side to the secondary transfer roller side. Then, the toner image on the intermediate transfer belt is secondarily transferred to a recording sheet which is fed into the secondary transfer nip at a timing synchronized with a transfer operation of the toner image on the intermediate transfer belt by the action of the secondary transfer electric field.

With this configuration, if a sheet, such as a Japanese sheet having a high degree of surface roughness is used as the recording sheet, a light-and-shade pattern according to the surface roughness is easily generated in an image. This light-and-shade pattern is due to the insufficient amount of toner transferred to recessed portions which brings lower image densities in the recessed portions of the sheet surface than protruding portions. For this reason, in the image forming apparatus disclosed in Japanese Patent Application Laid-open No. 2006-267486, as the secondary transfer bias, a bias composed only of a DC voltage is not used but a superimposed bias in which a DC voltage is superimposed on an AC voltage is applied. Japanese Patent Application Laid-open No. 2006-267486 reports a test result presenting that applying such a secondary transfer bias (superimposed bias) suppresses occurrence of a light-and-shade pattern as compared with a case of using a secondary transfer bias composed only of a DC voltage. Further, the same document also reports another test result. The test result implies that, as a peak-to-peak voltage Vpp of an AC component of the secondary transfer bias increases from a near zero voltage, image densities of recessed portions on the surface of a recording sheet increase gradually, whereas if the value of the Vpp is larger than twice the DC voltage, as the Vpp increases, the image densities of the recessed portions decrease. According to this test result, the densities of the recessed portions become the highest by adopting the value of the peak-to-peak voltage Vpp at a timing that is immediately before a change from a tendency to increase the image densities of the recessed portions on the surface of the recording sheet to a tendency to decreases the image densities of the recessed portions in a process of gradually increasing the peak-to-peak voltage Vpp, that is, the value of the Vpp which is about twice the DC voltage is used.

However, the inventors of the present invention have found through the tests that, in a case of focusing only on transferring a sufficient amount of toner into the recessed portions of the surface of the recording sheet, that is, in a case of applying the value of the Vpp which is about twice the DC voltage, a good result is not obtained. That is, it is found that in order to obtain a sufficient image density in the recessed portions, the value of the Vpp must be more than that value. Specifically, according to the tests of the inventors of the present invention, unlike the test results disclosed in Japanese Patent Application Laid-open No. 2006-267486, even when the value of the Vpp was larger than twice the DC voltage, the image densities of the recessed portions increased as the value of the Vpp increased. However, when the value of the Vpp was made relatively large, in a particularly deep recessed portion of the recessed portions, a discharge occurred between the bottom of the particularly deep recessed portion and the intermediate transfer belt, resulting in white dots, dot-shaped lacks, in the image. If a number of white dots are generated and the white dots are connected long, it may appear the image densities of the recessed portions fall significantly short of the mark. However, a shortage in the image densities and the white dots are completely different phenomena. Specifically, the shortage in the image densities is caused when an insufficient amount of toner is transferred from the intermediate transfer belt or the like into the recessed portions of the surface the recording sheet, whereas the white dotes are generated when the toner oppositely charged due to the discharge cannot be transferred into the recessed portions. Even in an image in which a large number of white dots were generated so that it appeared as if a significant storage in the image densities of the recessed portions was caused, a higher image density than that obtainable in a case that the Vpp was set at twice the DC voltage was obtained in a relatively shallow recessed portion of the recessed portions. In other words, it is considered that even in the tests disclosed in Japanese Patent Application Laid-open No. 2006-267486, if the white dots and the shortage in the image densities are precisely distinguished, similarly to the tests conducted by the inventors of the present invention, even in a high potential area where the potential is larger than twice the DC voltage, the image densities increase as the value of the Vpp increases. Further, according to the tests of the inventors of the present invention, in order to obtain allowable levels of image densities at the recessed portions, the value of the Vpp needs to be four times larger than the DC voltage.

Moreover, it has also been found that, for example, even when the value of the Vpp is made larger than four times the DC voltage, if a sheet having a relatively large thickness or a relatively high degree of surface roughness is used as the recording sheet, sufficient image densities may not be obtained at the recessed portions on the surface of the recording sheet.

For this reason, the inventors of the present invention conducted tests using recording sheets having a large thickness and a high degree of surface roughness, and, as a result, found that, in order to obtain sufficient image densities at the recessed portions of the surface of the recording sheet, the value of the Vpp should be made larger than six times the DC voltage.

Until now, the image forming apparatus having a configuration in which the toner image is transferred to the recording sheet at the secondary transfer nip has been described. However, even in a configuration in which a toner image is transferred from a photosensitive element to a recording sheet at a transfer nip formed by contact of the photosensitive element and a transfer roller or the like, the same problems may occur.

SUMMARY OF THE INVENTION

It is an object of the present invention to at least partially solve the problems in the conventional technology.

According to an aspect of the present invention, there is provided a transfer device that includes: an image carrier for carrying a toner image; a nip forming member for forming a transfer nip between the nip forming member and an image carrier by contacting with a front surface of the image carrier; and a transfer bias applying unit for applying a transfer bias, thereby transferring the toner image carried on the image carrier to a recording material at a position of the transfer nip. The transfer bias applying unit applies the transfer bias in which an AC component and a DC component are superimposed and in which a peak-to-peak voltage of the AC component is larger than 6 times an absolute value of a voltage of the DC component.

According to an aspect of the present invention, there is provided an image forming apparatus includes the above-mentioned transfer device. The transfer device transfers the toner image carried on the surface of the image carrier or a latent image carrier to the recording material inserted into the transfer nip formed by contact of the image carrier and the nip forming member, or a transfer nip formed by contact of the latent image carrier and the nip forming member.

According to an aspect of the present invention, there is provided a transfer device that includes: a nip forming member for forming a transfer nip by contacting with a front surface of an image carrier; a rear-surface abutting member for contacting with a rear surface of the image carrier; and a voltage output unit for outputting a voltage to generate a potential difference including a DC component and an AC component between the rear-surface abutting member and the nip forming member or a pressing member, the pressing member pressing the nip forming member toward the image carrier. A toner image carried on a front surface of the image carrier is transferred to a recording material inserted into the transfer nip. The voltage output unit is configured to output, as the voltage, a voltage satisfying a relation of '$\frac{1}{6} \times Vpp > |Voff|$' between a peak-to-peak voltage Vpp [V] of an AC component and an offset voltage Voff [V] which is an hourly averaged value of a potential. As the offset voltage Voff, generated is a voltage that causes a potential of the nip forming member or the pressing member to be larger than a potential of the rear-surface abutting member on an opposite polarity side to a charged polarity of toner.

According to an aspect of the present invention, there is provided an image forming apparatus includes the above-mentioned transfer device. The transfer device transfers the toner image carried on the surface of the image carrier or a latent image carrier to the recording material inserted into the transfer nip formed by contact of the image carrier and the nip forming member, or a transfer nip formed by contact of the latent image carrier and the nip forming member.

According to an aspect of the present invention, there is provided a transfer method that includes: a nip forming process of forming a transfer nip between a nip forming member and an image carrier by bringing the nip forming member into contact with a front surface of the image carrier, the front surface carrying a toner image; and a transfer process of transferring the toner image carried on the image carrier to a recording material at a position of the transfer nip by applying a transfer bias. The transfer bias applied at the transferring is a transfer bias in which an AC component and a DC component are superimposed and in which a peak-to-peak voltage of the AC component is larger than 6 times an absolute value of a voltage of the DC component.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Prior to proceeding to description of an embodiment of an electrophotographic type of color printer (hereinafter, simply referred to as a printer) as an image forming apparatus to which the present invention is applied, hereinafter, a printer according to a reference example to be helpful in understanding the present invention will be described.

Figure 1:
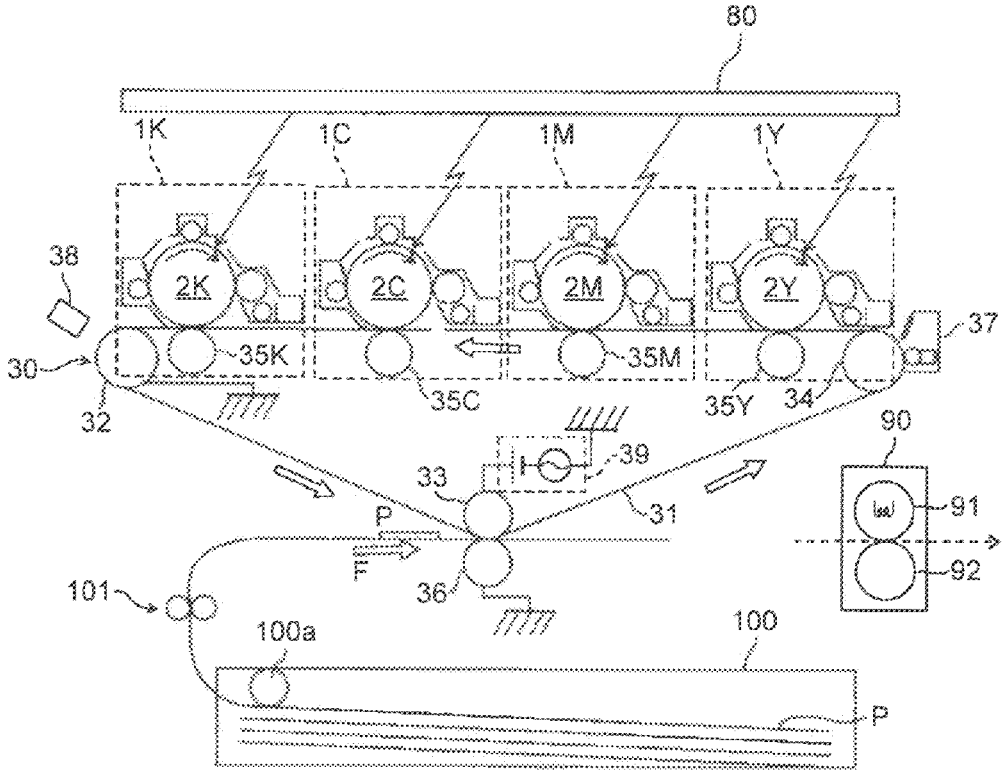
FIG. 1 is a schematic diagram illustrating a configuration of a printer according to a reference example.

First, a basic configuration of the printer according to the reference example will be described. FIG. 1 is a schematic view illustrating a configuration of the printer according to the reference example. In FIG. 1, the printer according to the reference example includes four image forming units 1Y, 1M, 1C, and 1K for forming toner images of yellow (Y), magenta (M), cyan (C), and black (K), a transfer unit 30 serving as a transfer device, an optical writing unit 80, a fixing unit 90, a paper cassette 100, and a pair of registration rollers 101.

Figure 2:
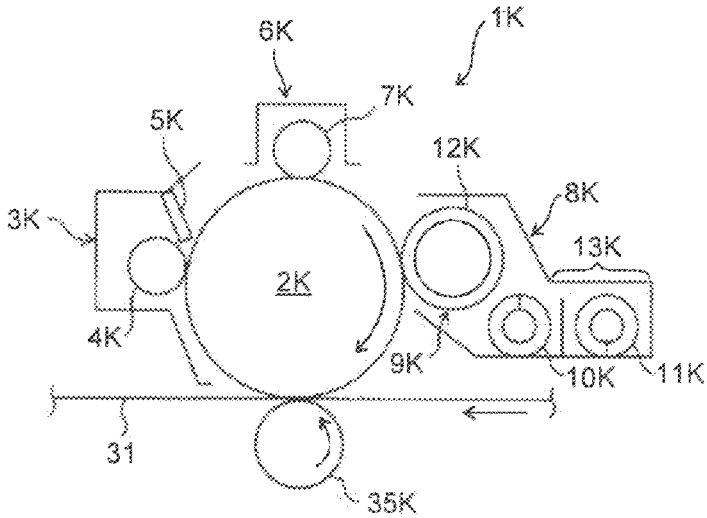
FIG. 2 is an enlarged view illustrating a configuration of an image forming unit for K in the printer.

The four image forming units 1Y, 1M, 1C, and 1K have the same configuration except that Y toner, M toner, C toner, and K toner, having colors different from each other, are respectively used as image forming substances, and are replaced when reached the ends of their life spans. For example, as shown in FIG. 2, the image forming unit 1K for forming a K toner image includes a drum-shaped photosensitive element 2K serving as a latent-image carrier, a drum cleaning unit 3K, a neutralization unit (not shown), a charging unit 6K, a developing unit 8K, and so on. These units may be held in a common holding element, and be integrally attached to and detached from a main body of the printer, such that the units can be replaced at the same time.

The photosensitive element 2K has a drum shape in which an organic photosensitive layer is formed on a surface of a drum base and whose outer diameter is about 60 mm, and is driven to rotate clockwise in FIG. 2 by a driving unit (not shown). The charging unit 6K brings a roller charging unit 7K, to which a charging bias is applied, into contact or close proximity with the photosensitive element 2K so as to cause discharge between the roller charging unit 7K and the photosensitive element 2K, thereby uniformly charging the surface of the photosensitive element 2K. In the reference example, the surface of the photosensitive element 2K is uniformly charged to a negative polarity which is the same as a normally charged polarity of toner. As the charging bias, a bias in which an AC voltage is superimposed on a DC voltage is used. The roller charging unit 7K is formed by covering a surface of a metal cored bar with a conductive elastic layer made of a conductive elastic material. Instead of the method of bringing a charging member such as the roller charging unit into contact or close proximity with the photosensitive element 2K, a corona charger may be used.

The uniformly charged surface of the photosensitive element 2K is optically scanned by a laser beam coming from the optical writing unit to be described, so as to hold a K latent image. The K latent image is developed by the developing unit 8K using K toner (not shown) so as to be a K toner image. Then, the K toner image is primarily transferred on to an intermediate transfer belt 31 to be described.

The drum cleaning unit 3K removes transfer residual toner attached to the surface of the photosensitive element 2K after passing through the primary transfer process (a primary transfer nip to be described). The drum cleaning unit 3K includes a cleaning brush roller 4K driven to rotate, a cleaning blade 5K configured to bring a free end into contact with the photosensitive element 2K in a state in which the cleaning blade 5K is supported in a cantilever fashion, etc. The transfer residual toner is scraped off the surface of the photosensitive element 2K and is carried by the rotating cleaning brush roller 4K, or is scraped off the surface of the photosensitive element 2K and is dropped by the cleaning blade. Incidentally, the cleaning blade 5K contacts with the photosensitive element 2K in such a manner that the free end thereof contacts with the photosensitive element 2K at an upper stream position than the cantilever-like supported end thereof with respect to the rotation direction of the drum (photosensitive element 2K). Such a contact manner is called herein a "counter direction contact".

The neutralization unit neutralizes residual charge of the photosensitive element 2K cleaned by the drum cleaning unit 3K. The surface of the photosensitive element 2K is initialized by the neutralization, so as to be ready for the next image formation.

The developing unit 8K includes a developing unit 12K containing a developing roller 9K, and a developer feed unit 13K for stirring and feeding a K developer (not shown). The developer feed unit 13K includes a first feed chamber for accommodating a first screw member 10K and a second feed chamber for accommodating a second screw member 11K. Each of the screw members includes a rotation shaft member in which both end portions in an axis line direction are rotatably supported by bearings, respectively, and a spiral blade provided to protrude in a spiral shape on a peripheral surface of the rotation shaft member.

The first feed chamber accommodating the first screw member 10K and the second feed chamber accommodating the second screw member 11K are divided by a partition wall. At both end portions of the partition wall in a screw axis line direction, communication openings are formed to communicate both feed chambers each other. The first screw member 10K feeds a K developer (not shown) carried in the spiral blade from a rear side to a front side in a direction perpendicular to the plane of FIG. 2 while stirring the developer in the rotation direction of the first screw member by the rotation thereof. Since the first screw member 10K and a developing roller 9K to be described are disposed in parallel to face each other, in this case, the feed direction of the K developer is also a direction along a rotation axis line direction of the developing roller 9K. The first screw member 10K feeds the K developer to a surface of the developing roller 9K along the axis line direction thereof.

The K developer fed up to the vicinity of a front-side end portion of the first screw member 10K in FIG. 2 enters the second feed chamber through the communication openings provided in the vicinity of the front-side end portion of the partition wall in FIG. 2, and is carried in the spiral blade of the second screw member 11K. Then, the K developer is fed from the front side to the rear side in FIG. 2 while being stirred in the rotation direction of the second screw member 11K by the rotation thereof.

Inside the second feed chamber, a toner density sensor (not shown) is provided on a lower wall of a casing to detect a K toner density of the K developer in the second feed chamber. As the K toner density sensor, a sensor formed of a permeability sensor may be used. Since the permeability of the K developer containing the K toner and a magnetic carrier has a correlation with a K toner density, the permeability sensor detects the K toner density.

In this printer, Y, M, C, and K toner supplement units (not shown) are provided to supplement Y, M, C, and K toner into the second feed chambers of the Y, M, C, and K developing units, respectively. A control unit of the printer stores Vtref for Y, M, C, and K, which are target values for output voltage values from the Y, M, C, and K toner density detecting sensors, in a RAM. In a case that the differences between the output voltage values from the Y, M, C, and K toner density detecting sensors and the Vtref for Y, M, C, and K exceed a predetermined value, the Y, M, C, and K toner supplement units are driven for time periods according to the differences. Therefore, the Y toner, the M toner, the C toner, and the K toner are supplemented into the second feed chambers of the Y, M, C, and K developing units.

The developing roller 9K accommodated in the developing unit 12K faces the first screw member 10K and also faces the photosensitive element 2K through the opening provided to the casing. The developing roller 9K includes a cylindrical developing sleeve composed of a non-magnetic pipe driven to rotate, and a magnetic roller fixed inside the developing roller 9K so as not to rotate with the sleeve. The developing roller 9K feeds the K developer fed from the first screw member 10K to a developing area facing the photosensitive element 2K by the rotation of the sleeve while holding the K developer on a surface of the sleeve by a magnetic force emanating from the magnetic roller.

A developing bias is applied to the developing sleeve, the developing bias having the same polarity as the toner, being higher than a potential of the electrostatic latent image on the photosensitive element 2K, and being lower than a uniformly charged potential of the photosensitive element 2K. Therefore, between the developing sleeve and the electrostatic latent image on the photosensitive element 2K, a developing potential serves to move the K toner on the developing sleeve toward the electrostatic latent image. Further, between the developing sleeve and a surface portion of the photosensitive element 2K, a non-developing potential serves to move the K toner on the developing sleeve toward the sleeve surface. The actions of the developing potential and the non-developing potential selectively transfer the K toner on the developing sleeve to the electrostatic latent image on the photosensitive element 2K, thereby developing the electrostatic latent image into a K toner image.

In FIG. 1 described above, even in the Y, M, and C image forming units 1Y, 1M, and 10, similarly to the K image forming unit 1K, Y, M, and C toner images are formed on the photosensitive elements 2Y, 2M, and 2C.

Above the image forming units 1Y, 1M, 10, and 1K, the optical writing unit 80 serving as a latent image writing unit is disposed. The optical writing unit 80 optically scans the photosensitive elements 2Y, 2M, 2C, and 2K by laser beams coming from laser diodes on the basis of image information transmitted from an external device such as a personal computer. Y, M, C, and K electrostatic latent images are formed on the photosensitive elements 2Y, 2M, 2C, and 2K by the optical scanning. Specifically, on the uniformly charged entire surface of the photosensitive element 2Y, at a portion irradiated with a laser beam, a potential is lowered. Therefore, the potential of the portion irradiated with the laser beam becomes the electrostatic latent image having a potential lower than the potential of the other area (surface portion). Also, the optical writing unit 80 irradiates the photosensitive elements with a laser beam L coming from a light source through a plurality of optical lenses and mirrors while polarizing the laser beam L in a main scan direction by a polygon mirror driven to rotate by a polygon motor (not shown). The optical writing may be performed by LED beams coming from a plurality of LEDs of an LED array.

Below the image forming units 1Y, 1M, 10, and 1K, a transfer unit 30 is disposed as a transfer device which endlessly moves the endless intermediate transfer belt 31 counterclockwise in FIG. 1 while hanging the endless intermediate transfer belt 31. The transfer unit 30 includes not only the intermediate transfer belt 31 serving as an image carrier, but also a driven roller 32, a secondary-transfer rear-surface roller 33, a cleaning backup roller 34, four primary transfer rollers 35Y, 35M, 35C, and 35K, a nip forming roller 36, a belt cleaning unit 37, a potential sensor 38, and so on.

The intermediate transfer belt 31 is hung by the driven roller 32, the secondary-transfer rear-surface roller 33, the cleaning backup roller 34, and the four primary transfer rollers 35Y, 35M, 35C, and 35K disposed inside the intermediate transfer belt 31. The intermediate transfer belt 31 endlessly moves counterclockwise by a rotation force of the driven roller 32 driven to rotate counterclockwise in FIG. 1 by a driving unit (not shown). As the intermediate transfer belt 31, an intermediate transfer belt having the following characteristics is used. That is, the thickness is 20 μm to 200 μm, preferably, about 60 μm. Also, the volume resistivity is $1\times10^{6}$ Ω·cm to $1\times10^{12}$ Ω·cm, preferably, about $1\times10^{9}$ Ω·cm (measured with HIRESTA-UP (MCP-HT45) manufactured by Mitsubishi Chemical Corporation under the condition of applied voltage of 100 V). Further, the material is composed of a carbon-dispersed polyimide resin.

The intermediate transfer belt 31 moving endlessly are interposed between the four primary transfer rollers 35Y, 35M, 35C, and 35K and the photosensitive elements 2Y, 2M, 2C, and 2K. Therefore, the front surface of the intermediate transfer belt 31 and the photosensitive elements 2Y, 2M, 2C, and 2K come into contact with each other so as to form primary transfer nips for Y, M, C, and K. A primary transfer bias is applied to each of the primary transfer rollers 35Y, 35M, 35C, and 35K by a transfer bias power supply (not shown). Therefore, transfer electric fields are formed between the Y, M, C, and K toner images on the photosensitive elements 2Y, 2M, 2C, and 2K and the primary transfer rollers 35Y, 35M, 35C, and 35K. The Y toner formed on the surface of the Y photosensitive element 2Y for Y enters the primary transfer nip for Y by the rotation of the photosensitive element 2Y. Then, the Y toner is primarily transferred from the photosensitive element 2Y to the intermediate transfer belt 31 by actions of the transfer electric field or the nip pressure. Next, the intermediate transfer belt 31 to which the Y toner image has been transferred in that way passes through the primary transfer nips for M, C, and K, in turn. Then, the M, C, and K toner images on the photosensitive elements 2M, 2C, and 2K are sequentially primarily transferred to be superimposed on the Y toner image. A four-color superimposed toner image is formed on the intermediate transfer belt 31 by the primary transfer of the superimposing.

The primary transfer rollers 35Y, 35M, 35C, and 35K are composed of elastic rollers having metal cored bars and conductive sponge layers fixed on the metal cored bars, and have the following characteristics. That is, the external diameter is 16 mm. Also, the diameter of the cored bars is 10 mm. Further, the resistance R of the sponge layers calculated from a current I flowing when a voltage of 1000 V was applied to the cored bars of the primary rollers in a state that a grounded metal roller with an external diameter of 30 mm is pressed against the sponge layers with a force of 10 N, on the basis of Ohm's law (R=V/I) is about $3\times10^{7}\Omega$. With respect to the primary transfer rollers 35Y, 35M, 35C, and 35K, the primary transfer bias is applied under constant current control. Instead of the primary transfer rollers 35Y, 35M, 35C, and 35K, transfer chargers, transfer brushes, and the like may be used.

The nip forming roller 36 of the transfer unit 30 is disposed outside a loop of the intermediate transfer belt 31, such that the intermediate transfer belt 31 is interposed between the nip forming roller 36 and the secondary-transfer rear-surface roller 33 on the inside of the loop. Therefore, the front surface of the intermediate transfer belt 31 and the nip forming roller 36 come into contact with each other so as to form a secondary transfer nip. While the nip forming roller 36 is grounded, a secondary transfer bias is applied to the secondary-transfer rear-surface roller 33 by a secondary transfer bias power supply 39. Therefore, between the secondary-transfer rear-surface roller 33 and the nip forming roller 36, a secondary transfer electric field is formed to electrostatically move the toner having the negative polarity from the secondary-transfer rear-surface roller 33 to the nip forming roller 36.

Below the transfer unit 30, the paper cassette 100 accommodating a pile of a plurality of recording sheets P is disposed. The paper cassette 100 brings the top recording sheet P of the sheet pile into contact with a paper feeding roller 100*a*, and the paper feeding roller 100*a* is driven to rotate at a predetermined timing, so as to send the recording sheet P toward a paper conveying path. In the vicinity of an end of the paper conveying path, the pair of registration rollers 101 is provided. If the recording sheet P sent from the paper cassette 100 is inserted between the pair of registration rollers 101, the rollers immediately stop rotating. Then, the pair of registration rollers 101 restarts rotating to send the recording sheet P toward the secondary transfer nip at a timing capable of being synchronized with the four-color superimposed toner image on the intermediate transfer belt 31 in the secondary transfer nip. The four-color superimposed toner image on the intermediate transfer belt 31 brought into close contact with the recording sheet P in the secondary transfer nip is secondarily transferred to the recording sheet P at once by the actions of the secondary transfer electric field or the nip pressure, so as to be a full-color toner image together with the white color of the recording sheet P. If passing through the secondary transfer nip, the recording sheet P having a surface on which the full-color toner image has formed in that way leaves the nip forming roller 36 and the intermediate transfer belt 31 through self stripping.

The secondary-transfer rear-surface roller 33 has the following characteristics. That is, the external diameter is about 24 mm. Also, the diameter of the cored bar is about 16 mm. The surface of the cored bar is covered with a conductive NBR-based rubber layer, and the resistance R thereof is $1\times10^{6}\Omega$ to $1\times10^{12}\Omega$, preferably, about $4\times10^{7}\Omega$. The resistance R is a value measured by the same method as that used for the primary transfer rollers.

Also, the nip forming roller 36 has the following characteristics. That is, the external diameter is about 24 mm. Also, the diameter of the cored bar is about 14 mm. The surface of the cored bar is covered with a conductive NBR-based rubber layer, and the resistance R thereof is $1\times10^{6}\Omega$ or less. The resistance R is a value measured by the same method as that used for the primary transfer rollers.

The secondary transfer bias power supply 39 includes a DC power supply and an AC power supply, and can output a bias in which an AC voltage is superimposed on a DC voltage, as the secondary transfer bias. An output terminal of the secondary transfer bias power supply 39 is connected to the cored bar of the nip forming roller 36. The potential of the cored bar of the nip forming roller 36 becomes almost the same value as an output voltage value from the secondary transfer bias power supply 39. As for the secondary-transfer rear-surface roller 33, the cored bar is grounded (connected to the ground). Instead of grounding the cored bar of the nip forming roller 36 while applying the superimposed bias to the cored bar of the secondary-transfer rear-surface roller 33, the cored bar of the secondary-transfer rear-surface roller 33 may be grounded while applying the superimposed bias to the cored bar of the nip forming roller 36. In this case, the polarity of the DC voltage is changed. Specifically, as shown in FIG. 1, in a case that the superimposed bias is applied to the secondary-transfer rear-surface roller 33 on condition that the toner having the negative polarity is used and the nip forming roller 36 is grounded, as the DC voltage, a DC voltage having the negative polarity like the toner is used to make an hourly averaged potential of the superimposed bias have the negative polarity like the toner. In contrast, in the case that the secondary-transfer rear-surface roller 33 is grounded and the superimposed bias is applied to the nip forming roller 36, as the DC voltage, a DC voltage having the opposite polarity to that of the toner is used to make the hourly averaged potential of the superimposed bias have the positive polarity opposite to that of the toner. Instead of applying the superimposed bias to the secondary-transfer rear-surface roller 33 or the nip forming roller 36, a DC voltage may be applied to any one roller, and at the same time, an AC voltage may be applied the other roller. As the AC voltage, an AC voltage having a sinusoidal waveform is used; however, an AC voltage having a rectangular waveform may be used. In a case that a sheet, such as plain paper, having a low degree of surface roughness is used as the recording sheet P without using a sheet, such as a type of Japanese paper, having a high degree of surface roughness, since a light-and-shade pattern according to the roughness pattern of the paper surface is not generated, a bias composed only of a DC voltage may be applied as the transfer bias. However, in the case that a sheet, such as a type of Japanese paper, having a high degree of surface roughness is used, it is required to change the transfer bias from the bias composed only of the DC voltage to the superimposed bias.

On the intermediate transfer belt 31 after passing through the secondary transfer nip, transfer residual toner that has not been transferred onto the recording sheet P is attached. The transfer residual toner is cleaned from the belt surface by the belt cleaning unit 37 that is in contact with the front surface of the intermediate transfer belt 31. The cleaning backup roller 34 disposed on the inside of the loop of the intermediate transfer belt 31 backs up the cleaning on the belt by the belt cleaning unit 37 from the inside of the loop.

The potential sensor 38 is disposed on the outside of the loop of the intermediate transfer belt 31. Also, the potential sensor 38 faces a portion wound around the grounded driven roller 32, in the entire area in the circumferential direction of the intermediate transfer belt 31, with a gap of about 4 mm. When the primarily transferred toner image on the intermediate transfer belt 31 reaches a position where the toner image faces the potential sensor 38, the potential sensor 38 measures a surface potential of the toner image. As the potential sensor 38, EFS-22D manufactured by TDK Corporation is used.

On the right side of the secondary transfer nip in FIG. 1, the fixing unit 90 is disposed. In the fixing unit 90, a fixing nip is formed by a fixing roller 91 containing a heat generating source such as a halogen lamp and a pressing roller 92 rotating while being in contact with the fixing roller 91 with a predetermined pressure. The recording sheet P sent into the fixing unit 90 is inserted into the fixing nip with a posture in which an unfixed-toner-image holding surface of the recording sheet P comes into close contact with the fixing roller 91. Then, the toner of the toner image is softened and the full-color image is fixed under the influence of heating or pressing. The recording sheet P discharged from the fixing unit 90 is discharged to the outside of the apparatus through a post-fixing conveying path.

In a case of forming a monochrome image, support plates (not shown) supporting the primary transfer rollers 35Y, 35M, and 35C for Y, M, and C in the transfer unit 30 move so as to keep the primary transfer rollers 35Y, 35M, and 35C away from the photosensitive elements 2Y, 2M, and 2C. Thereby, the front surface of the intermediate transfer belt 31 is separated from the photosensitive elements 2Y, 2M, and 2C, and is in contact only with the photosensitive element 2K for K. In this state, among the four image forming units 1Y, 1M, 10, and 1K, only the image forming unit 1K for K is driven, such that the K toner image is formed on the photosensitive element 2K.

Figure 3:
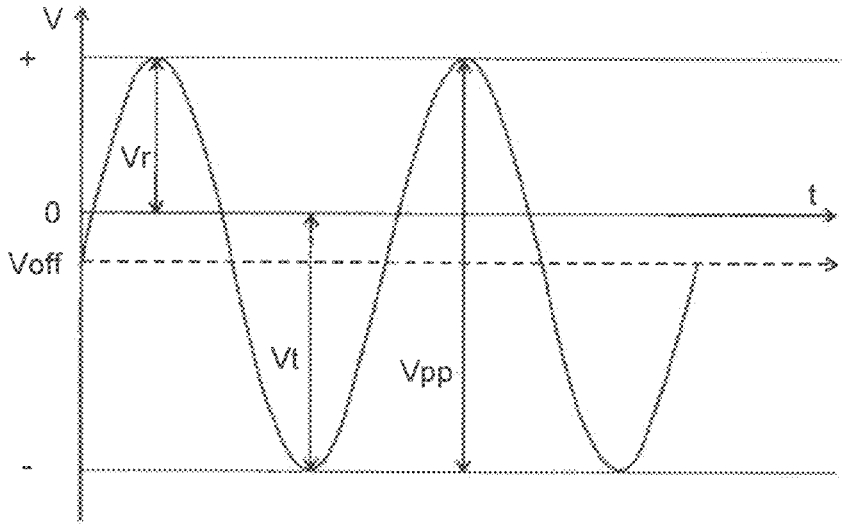
FIG. 3 is a waveform diagram illustrating a waveform of a secondary transfer bias formed of a superimposed bias output from a secondary transfer bias power supply of the printer.

FIG. 3 is a waveform diagram illustrating a waveform of a secondary transfer bias composed of a superimposed bias output from the secondary transfer bias power supply 39. In FIG. 3, the symbol "t" means time. In FIG. 3, the secondary transfer bias is applied to the cored bar of the secondary-transfer rear-surface roller, as described above. The secondary transfer bias power supply 39 is a voltage output unit, and serves as a transfer bias applying unit for applying a transfer bias. As described above, if the secondary transfer bias is applied to the cored bar of the secondary-transfer rear-surface roller, a potential difference occurs between the cored bar of the secondary-transfer rear-surface roller which is a first member and the cored bar of the nip forming roller which is a second member. Therefore, the secondary transfer bias power supply 39 also acts as a potential difference generating unit. The potential difference is generally handled as an absolute value; however, it is handled as a value with a polarity in this specification. More specifically, a value obtained by subtracting the potential of the cored bar of the nip forming roller from the potential of the cored bar of the secondary-transfer rear-surface roller is handled as the potential difference. In a case that the polarity of the hourly averaged value of the potential difference becomes negative in the configuration that the toner having the negative polarity is used as in the reference example, the potential of the nip forming roller becomes larger than the potential of the secondary-transfer rear-surface roller on the opposite polarity side (the positive side in the present embodiment) to the charged polarity of the toner. Therefore, the toner electrostatically moves from the secondary-transfer rear-surface roller side to the nip forming roller side.

In FIG. 3, an offset voltage Voff is the value of the DC component of the secondary transfer bias. Also, a peak-to-peak voltage Vpp is the peak-to-peak voltage of the AC component of the secondary transfer bias. In the printer according to the reference example, as described above, the secondary transfer bias is a superimposed bias of the offset voltage Voff and the peak-to-peak voltage Vpp, and the hourly averaged value of the secondary transfer bias becomes the same value as the offset voltage Voff. Also, in the printer according to the reference example, as described above, the secondary transfer bias is applied to the cored bar of the secondary-transfer rear-surface roller and the cored bar of the nip forming roller is grounded (0 V). Therefore, the potential of the cored bar of the secondary-transfer rear-surface roller itself becomes the potential difference between both cored bars. The potential difference between both cored bars is composed of a DC component Eoff having the same value as the offset voltage Voff and an AC component Epp having the same value as the peak-to-peak voltage Vpp.

As shown in FIG. 3, in the printer according to the reference example, a negative voltage is used as the offset voltage Voff. Since the polarity of the offset voltage Voff of the secondary transfer bias applied to the secondary-transfer rear-surface roller 33 is made negative, in the secondary transfer nip, the toner having the negative polarity can be relatively forced from the secondary-transfer rear-surface roller 33 side to the nip forming roller 36 side. When the polarity of the secondary transfer bias is negative like the toner, in the secondary transfer nip, the toner having the negative polarity is electrostatically forced from the secondary-transfer rear-surface roller 33 side to the nip forming roller 36 side. Thereby, the toner on the intermediate transfer belt 31 is transferred onto the recording sheet P. Meanwhile, when the polarity of the secondary transfer bias is the positive polarity opposite to that of the toner, in the secondary transfer nip, the toner having the negative polarity is electrostatically drawn from the nip forming roller 36 side toward the secondary-transfer rear-surface roller 33 side. Thereby, the toner transferred onto the recording sheet P is redrawn to the intermediate transfer belt 31. However, since the hourly averaged value (the same value as the offset voltage Voff in the present embodiment) of the secondary transfer bias has the negative polarity, relatively, the toner is electrostatically forced from the secondary-transfer rear-surface roller 33 side to the nip forming roller 36 side. In FIG. 3, a return potential peak value Vr represents a positive peak value having the opposite polarity to that of the toner.

Next, the tests conducted by the inventors of the present invention will be described.

The inventors of the present invention prepared a print test apparatus having the same configuration as the printer according to the reference example. Then, various print tests were conducted by using the print test apparatus. In the various tests, as the developer, a substance containing grinded polyester-based toner having an average grain diameter of 6.8 μm and magnetic carriers having an average grain diameter of 55 μm and having surfaces covered with resin layers was used.

First Print Test

As the offset voltage Voff, −0.8 kV was used. Specifically, in the print test, since the nip forming roller 36 was grounded, the DC component of the secondary transfer bias composed of the superimposed bias was set at −0.8 kV. Also, as the AC component, an AC component having a peak-to-peak voltage Vpp of 2.5 kV was used. The frequency f [Hz] of the AC component and a process linear velocity (the linear velocities of the intermediate transfer belt and the photosensitive elements) were appropriately changed. Under conditions different from each other in the frequency f and the process linear velocity, black solid test images were output on recording sheets P that were plain paper. Then, the qualities of the output black solid images were visually evaluated on a two-point scale. Cases where density irregularity (pitch irregularity) synchronized with the frequency of the AC component was not visible were marked with '○', and cases where density irregularity (pitch irregularity) synchronized with the frequency of the AC component was visible were marked with 'x'. The results are shown in the following Table 1.

TABLE 1

| Process Linear velocity | Frequency f [Hz] | | | | | | | | |
|---|---|---|---|---|---|---|---|---|---|
| [mm/s] | 50 | 100 | 200 | 300 | 400 | 500 | 600 | 700 | |
| 282 | x | x | x | x | ○ | ○ | ○ | ○ | Evaluation |
| 141 | x | x | ○ | ○ | ○ | ○ | ○ | ○ | |

As shown in Table 1, in a case that the process linear velocity v was set at 282 mm/s, it was possible to prevent occurrence of the pitch irregularity by setting the frequency f of the AC component at 400 Hz or greater. Also, in a case that the process linear velocity v was set at 141 mm/s, it was possible to prevent occurrence of the pitch irregularity by setting the frequency f of the AC component at 200 Hz or greater. The lower limit of the frequency f capable of preventing occurrence of the pitch irregularity changes according to the process linear velocity v, and this is because the number of alternating electric fields acting the toner in the secondary transfer nip changes according to the process linear velocity v. Specifically, hereinafter, a nip width is defined as d [mm]. In that case, the nip width equals a length in a roller surface movement direction of the secondary transfer nip, which is formed by the direct contact of the intermediate transfer belt 31 and the nip forming roller 36 in a state that the recording sheet P is not inserted therebetween. A nip transit time [s] required for secondary-transfer-nip transit is expressed in a formula of '(Nip Width d)/(Process Linear Velocity v)'. Meanwhile, under conditions of the frequency f [Hz], the period [s] of the AC component of the superimposed bias is expressed in a formula of '1/(Frequency f)'. Therefore, in the nip transit time, a one-period waveform of the AC component is applied by the number of times (d×f/v). In the print test apparatus, the nip width d is 3 mm. As shown in Table 1, when the process linear velocity v is 282 mm/s, a required number of waveforms can be calculated to about 4.26 (3×400/282), since a lower limit of the frequency "f" capable of preventing an occurrence of the pitch irregularity is 400 Hz. This means that the occurrence of pitch irregularity can be avoided by working alternating electric fields to the toner within the secondary transfer nip approximately by the number of times 4.26. In a case that the process linear velocity "v" is 141 mm/s, a required number of waveforms can be calculated to about 4.26 (3×200/141), since a lower limit of the frequency "f" capable of preventing an occurrence of the pitch irregularity is 200 Hz. This is the same value as that in the case of 400 Hz. From these, it can be said that it is possible to obtain a good image without the pitch irregularity by causing the alternating electric fields to act about four times during the secondary-transfer-nip transit. In other words, in order to obtain a good image without the pitch irregularity, a condition of '4<d×f/v' needs to be satisfied.

Figure 4:
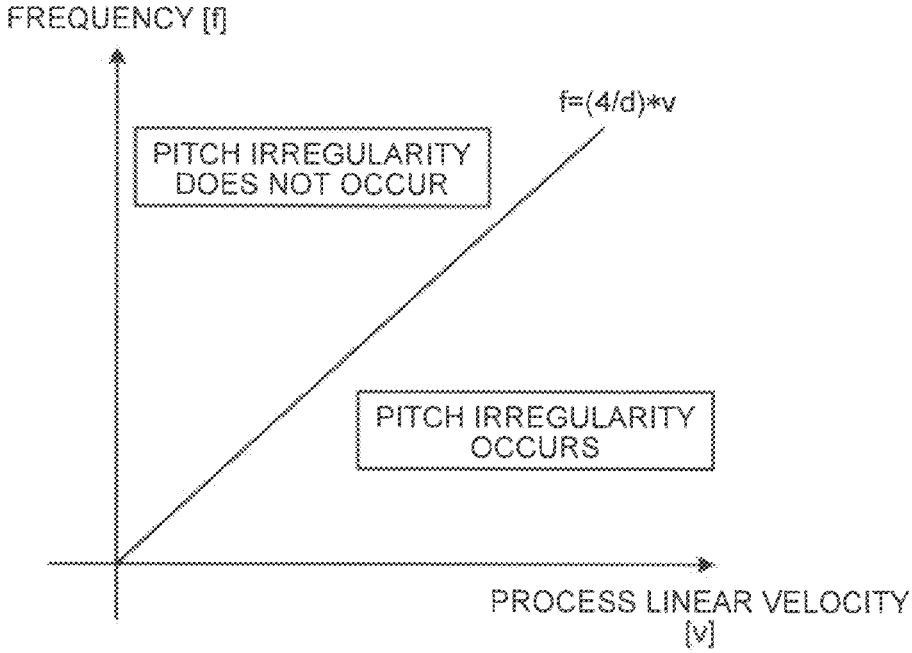
FIG. 4 is a graph illustrating a relation among a frequency f of an AC component of the secondary transfer bias formed of the superimposed bias, a process linear velocity v, and pitch irregularity.

FIG. 4 is a graph illustrating a relation among the frequency "f" of the AC component of the secondary transfer bias composed of the superimposed bias, the process linear velocity "v", and the pitch irregularity. As shown in FIG. 4, in a two-dimensional coordinate system in which a y axis represents the frequency "f" and an x axis represents the process linear velocity "v", the pitch irregularity occurs in an area lower than a straight line represented by an equation of 'f=(4/d)×v'. In contrast, in an area upper than the straight line, occurrence of the pitch irregularity can be prevented.

Second Print Test

As the recording sheet P, instead of the plain paper, FC Japanese paper type 'SAZANAMI' (a trade name) (manufactured by NBS Ricoh Co., Ltd.) was used. The FC Japanese paper type 'SAZANAMI' is paper having surface roughness like Japanese paper. If this paper is used, a light-and-shade pattern according to the surface roughness is likely to be generated. A black solid image being 70 mm long and 55 mm wide was used as a test image to be output. Then, with respect to test images output on recording sheets P, the evaluation was made in (i) the reproducibility of densities of recessed portions, (ii) the reproducibility of densities of protruding portions (smooth portions), and (iii) the appearance of white dots due to discharge.

The reproducibility of the densities of the recessed portions was evaluated as follows. That is, a case that a sufficient image density is obtained in the recessed portion was rated as Rank 5, since a sufficient amount of toner entered the recessed portions of the surface roughness.

Figure 5:
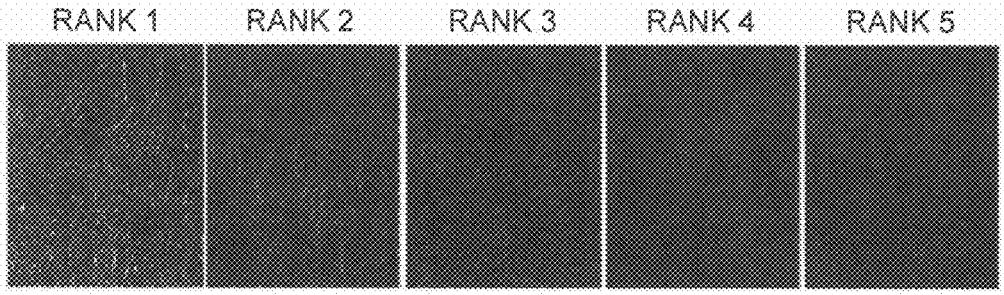
FIG. 5 is a view illustrating images in which results of evaluation of reproducibility of densities of recessed portions become Rank 1, Rank 2, Rank 3, Rank 4, and Rank 5, respectively.

Also, a case that a very small area in the recessed portions was a whited area, or the image densities of the recessed portions were slightly lower than those of the smooth portions was rated as Rank 4. Further, a case that the whited area was larger or a case that a decrease in density was noticeable as compared with Rank 4 was rated as Rank 3. Furthermore, a case that the whited area was larger or the decrease in the density was further noticeable, as compared to Rank 3, was rated as Rank 2. Moreover, a case that the recessed portions are generally white such that the states of grooves are generally perceived or the worse case was rated as Rank 1. For reference, black solid images of individual Ranks are shown in FIG. 5. An allowable level of image quality capable of being supplied to users is Rank 4 or higher.

Figure 6:
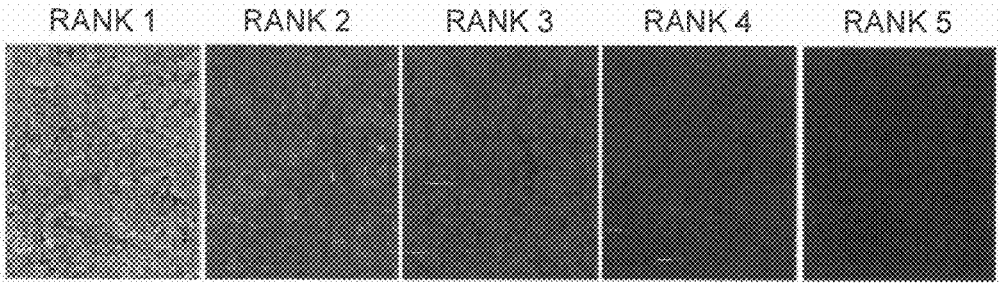
FIG. 6 is a view illustrating images in which results of evaluation of reproducibility of densities of protruding portions become Rank 1, Rank 2, Rank 3, Rank 4, and Rank 5, respectively.

The reproducibility of the densities of the protruding portions (smooth portions) was evaluated as follows. That is, a case that sufficient image densities were obtained at the protruding portions was rated as Rank 5. Also, a case that the densities that were problem-free but slightly lower as compared to Rank 5 was rated as Rank 4. Further, a case that the densities were further lower as compared to Rank 4 and became a problem in the image quality to be supplied to users was rated as Rank 3. Furthermore, a case that the densities were further lower as compared to Rank 3 was rated as Rank 2, and a case that the smooth portions were generally white or a case that the densities were further lower was rated as Rank 1. For reference, black solid images of individual Ranks are shown in FIG. 6. An allowable level of image quality capable of being supplied to users is Rank 4 or higher.

The second transfer bias may cause discharge in a micro gap between the recessed portions of the surface of the recording sheet P and the intermediate transfer belt 31 in the secondary transfer nip, such that white dots may appear in the image. The appearance of the white dots due to the discharge was evaluated as follows. That is, a case that white dots considered to be due to the discharge were not recognized was rated as Rank 5. Also, a case that a level at which white dots were recognized to a minor extent, but the number of the recognized white dots was small and the sizes of the white dots were small such that there was no problem in the image quality to be supplied to the users was rated as Rank 4.

Figure 7:
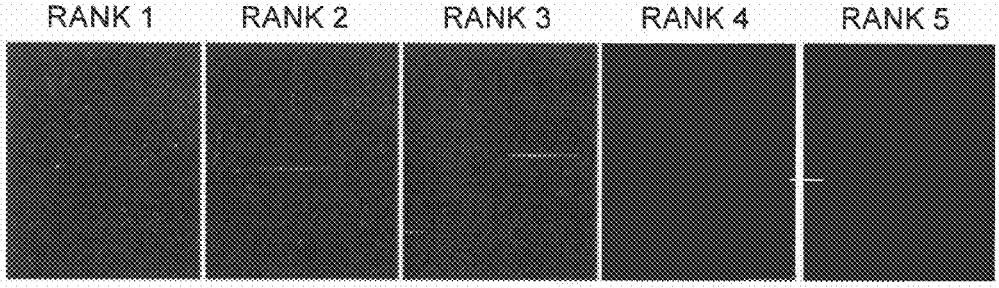
FIG. 7 is a view illustrating images in which results of evaluation of appearance of white dots become Rank 1, Rank 2, Rank 3, Rank 4, and Rank 5, respectively.

Further, a case that more white dots were recognized and more problems were noticeable, as compared to Rank 4, was rated as Rank 3. Furthermore, a case that further more white dots were recognized as compared to Rank 3 was rated as Rank 2. Moreover, a case that white dots are recognized in the entire image and that is worse than Rank 2 was rated as Rank 1. The white dots due to the discharge are generated as dots, whereas the recessed portions generally become white in a case that the densities of the recessed portions are extremely low. For reference, black solid images of individual Ranks are shown in FIG. 7. An allowable level of image quality capable of being supplied to users is Rank 4 or higher.

The second print test was conducted as follows. That is, first, a case that any alternating electric fields were not caused to completely act in the secondary transfer nip was evaluated as reference. For that purpose, a black solid test image was output by using the secondary transfer bias composed only of the DC component. The output test image was evaluated as mentioned before, that is, in (i) the reproducibility of densities of recessed portions, (ii) the reproducibility of densities of protruding portions (smooth portions), and (iii) the appearance of white dots due to discharge. The results are shown in the following Table 2.

TABLE 2

| | DC voltage [kV] | | | | | | | |
|---|---|---|---|---|---|---|---|---|
| | −1 | −1.5 | −2 | −2.5 | −3.5 | −4 | −4.5 | |
| Reproducibility of densities of recessed portions | 1 | 1 | 1 | 1 | 1 | 1 | 1 | Rated rank |
| Reproducibility of densities of protruding portions | 2 | 3 | 4 | 5 | 5 | 5 | 5 | |
| Appearance of white dots | 5 | 5 | 5 | 3 | 1 | 1 | 1 | |

As shown in Table 2, in the case that a bias composed only of a DC component is used as the secondary transfer bias, while the image densities of the protruding portions increases as the DC voltage increases, the required image densities cannot be obtained at the recessed portions. Regardless of the value of the DC voltage, the reproducibility of the densities of the recessed portions is Rank 1. Also, as the DC voltage increases, occurrence of white dots due to the discharge becomes noticeable. If the absolute value of the DC voltage having the negative polarity is larger than 2 kV, the appearance of white dots is lower than Rank 4 which is the allowable level.

Next, a superimposed bias was used as the secondary transfer bias to output the black solid test image. A frequency "f" of an AC component of the superimposed bias was fixed at 500 Hz. Also, the process linear velocity v was fixed at 282 mm/s. Further, a DC component (offset voltage Voff) was changed appropriately within a range of −0.6 kV to −2.0 kV. Furthermore, the peak-to-peak voltage Vpp of the AC component was changed appropriately within a range of 1.0 kV to 9.0 kV. Results of evaluation on the reproducibility of the densities of the recessed portions of black solid images output under those conditions are shown in the following Table 3.

TABLE 3

| Reproducibility of Densities of Recessed Portions | | Vpp [kV] 1 | 2 | 3 | 4 | 5 | 6 | 7 | 8 | 9 | |
|---|---|---|---|---|---|---|---|---|---|---|---|
| Voff [kV] | −2 | 1 | 1 | 1 | 2 | 2 | 2 | 3 | 3 | 3 | Rated rank |
| | −1.8 | 1 | 1 | 1 | 2 | 2 | 3 | 3 | 4 | 4 | |
| | −1.6 | 1 | 1 | 1 | 2 | 2 | 3 | 4 | 4 | 5 | |
| | −1.4 | 1 | 1 | 2 | 2 | 3 | 4 | 4 | 5 | 5 | |
| | −1.2 | 1 | 1 | 2 | 2 | 4 | 4 | 5 | 5 | 5 | |
| | −1 | 1 | 1 | 2 | 3 | 4 | 5 | 5 | 5 | 5 | |
| | −0.9 | 1 | 2 | 2 | 4 | 5 | 5 | 5 | 5 | 5 | |
| | −0.8 | 1 | 2 | 2 | 4 | 5 | 5 | 5 | 5 | 5 | |
| | −0.6 | 1 | 2 | 4 | 5 | 5 | 5 | 5 | 5 | 5 | |

As shown in Table 3, if the superimposed bias is used as the secondary transfer bias, it can be seen that the rated rank of the reproducibility of the densities of the recessed portions can be made 4 or higher according to the bias conditions. The reproducibility of the densities of the recessed portions trends to advance in rank as the peak-to-peak voltage Vpp of the AC component increases, and trends to advance in rank as the absolute value of the offset voltage Voff decreases.

Results of evaluation on the reproducibility of the densities of the protruding portions of the black solid images are shown in the following Table 4.

TABLE 4

| Reproducibility of Densities of Protruding Portions | | Vpp [kV] 1 | 2 | 3 | 4 | 5 | 6 | 7 | 8 | 9 | |
|---|---|---|---|---|---|---|---|---|---|---|---|
| Voff [kV] | −2 | 5 | 5 | 5 | 5 | 5 | 5 | 5 | 5 | 5 | Rated rank |
| | −1.8 | 5 | 5 | 5 | 5 | 5 | 5 | 5 | 5 | 5 | |
| | −1.6 | 5 | 5 | 5 | 5 | 5 | 5 | 5 | 5 | 5 | |
| | −1.4 | 5 | 5 | 5 | 5 | 5 | 5 | 5 | 5 | 5 | |
| | −1.2 | 5 | 5 | 5 | 5 | 5 | 5 | 5 | 5 | 5 | |
| | −1 | 5 | 5 | 5 | 5 | 5 | 5 | 5 | 5 | 5 | |
| | −0.9 | 4 | 4 | 4 | 4 | 4 | 4 | 4 | 4 | 4 | |
| | −0.8 | 3 | 3 | 3 | 3 | 3 | 3 | 3 | 3 | 3 | |
| | −0.6 | 1 | 1 | 1 | 1 | 1 | 1 | 1 | 1 | 1 | |

It can be seen that the image densities of the protruding portions (smooth portions) tend to increase as the absolute value of the offset voltage Voff increases. It is possible to make the reproducibility of the densities of the protruding portions Rank 4 or higher, which are allowable levels, by increasing the absolute value of the offset voltage Voff to a certain degree. Here, it is notable that, in the case of using the superimposed bias as the secondary transfer bias, it is possible to decrease the absolute value of the offset voltage Voff for making the reproducibility of the densities of the protruding portions Rank 4 or higher which are allowable levels, as compared to the case of using the bias composed only of the DC component (as compared to Table 2).

Results of evaluation on the appearance of white dots of the black solid images are shown in the following Table 5.

TABLE 5

| Appearance of White Dots | | Vpp [kV] 1 | 2 | 3 | 4 | 5 | 6 | 7 | 8 | 9 | |
|---|---|---|---|---|---|---|---|---|---|---|---|
| Voff [kV] | −2 | 5 | 5 | 4 | 4 | 4 | 2 | 1 | 1 | 1 | Rated rank |
| | −1.8 | 5 | 5 | 4 | 4 | 4 | 2 | 2 | 1 | 1 | |

TABLE 5-continued

| Appearance of White Dots | Vpp [kV] 1 | 2 | 3 | 4 | 5 | 6 | 7 | 8 | 9 |
|---|---|---|---|---|---|---|---|---|---|
| −1.6 | 5 | 5 | 5 | 4 | 4 | 3 | 2 | 1 | 1 |
| −1.4 | 5 | 5 | 5 | 4 | 4 | 4 | 2 | 2 | 1 |
| −1.2 | 5 | 5 | 5 | 4 | 4 | 4 | 3 | 2 | 1 |
| −1 | 5 | 5 | 5 | 5 | 4 | 4 | 3 | 2 | 1 |
| −0.9 | 5 | 5 | 5 | 5 | 4 | 4 | 4 | 2 | 2 |
| −0.8 | 5 | 5 | 5 | 5 | 4 | 4 | 4 | 2 | 2 |
| −0.6 | 5 | 5 | 5 | 5 | 5 | 4 | 4 | 3 | 2 |

It can be seen that, as the peak-to-peak voltage Vpp of the AC component decreases, occurrence of white dots due to the discharge tends to be suppressed. Meanwhile, it can be seen that, as the absolute value of the offset voltage Voff decreases, the occurrence of white dots due to the discharge tends to be suppressed.

Figure 8:
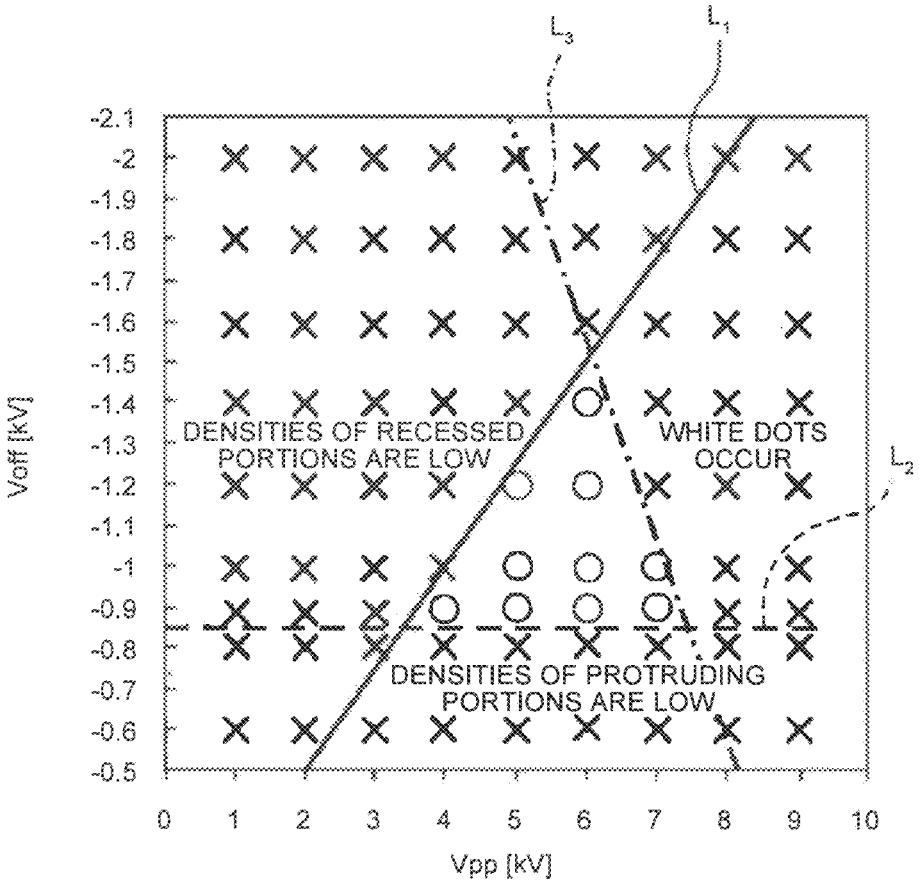
FIG. 8 is a graph illustrating a relation among an offset voltage Voff, a peak-to-peak voltage Vpp, the reproducibility of the densities of the recessed portions, the reproducibility of the densities of the protruding portions, and the appearance of white dots, made on the basis of results of a second print test.

FIG. 8 is a graph illustrating a relation among the offset voltage Voff, the peak-to-peak voltage Vpp, the reproducibility of the densities of the recessed portions, the reproducibility of the densities of the protruding portions, and the appearance of white dots, made on the basis of results of the second print test. As shown in FIG. 8, the graph was made in a two-dimensional coordinate system having a y axis representing the value of the offset voltage Voff and an x axis representing the value of the peak-to-peak voltage Vpp. On the two-dimensional coordinate system, three straight lines, a straight line L1 shown in a solid line, a straight line L2 shown in a dotted line, and a straight line L3 shown in an alternate long and short dash line, are shown. In the two-dimensional coordinate system shown in FIG. 8, in an area on the straight line L1 and in an area having y coordinates larger than the straight line L1 at the same x coordinates as the straight line L1, results in which the ranks of the reproducibility of the densities of the recessed portions were 3 or less lower than 4 which was the allowable level (the low densities of the recessed portions were noticeable) were obtained. For this reason, plotted points are shown by 'x'. Also, in an area on the straight line L2 and in an area having y coordinates larger than the straight line L2 at the same x coordinates as the straight line L2, results in which the ranks of the reproducibility of the densities of the protruding portions were 3 or less lower than 4 which was the allowable level (the low densities of the protruding portions were noticeable) were obtained. For this reason, plotted points are shown by 'x'. Further, in an area on the straight line L3 and in an area having y coordinates larger than the straight line L3 at the same x coordinates as the straight line L3, results in which the ranks of the appearance of white dots were 3 or less lower than the allowable level (white dots due to the discharge were noticeable) were obtained. For this reason, plotted points are shown by 'x'. In FIG. 8, in an area upper than the straight line L1 and lower than the straight line L2, the rank of the reproducibility of the densities of the recessed portions was lower than 4 and the rank of the reproducibility of the densities of the protruding portions was lower than 4. Also, in FIG. 8, in an area upper than the straight line L1 and upper than the straight line L3, the ranks of the reproducibility of the densities of the recessed portions were lower than 4, and the ranks of the appearance of white dots were lower than 4. Further, in FIG. 8, in an area lower than the straight line L2 and upper than the straight line L3, the reproducibility of the densities of the protruding portions was lower than 4, and the ranks of the appearance of white dots were lower than 4.

In FIG. 8, only test results in which all of the three evaluation items, (i) the reproducibility of the densities of the recessed portions, (ii) the reproducibility of the densities of the protruding portions, and (iii) the appearance of white dots were rated as Rank 4 or higher which were allowable levels are shown by circles. If attention is focused on only the reproducibility of the densities of the recessed portions, not the three items, when combinations of the offset voltages Voff and the peak-to-peaks voltage having coordinates lower than the straight line L1 in FIG. 8 are used, the reproducibility of the densities of the recessed portions becomes better. The straight line L1 is represented as Equation of 'Vpp=−4×Voff'. Therefore, if the secondary transfer bias satisfying a condition of '¼×Vpp>|Voff|' is used, sufficient image densities can be obtained at the recessed portions of the sheet surface.

Figure 9:
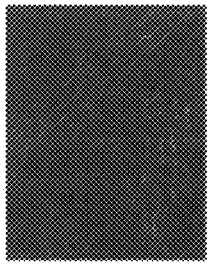
FIG. 9 is a view illustrating a black solid image output when a secondary transfer bias composed only of a DC voltage of 2.5 kV was applied.
Figure 10:
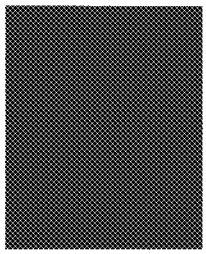
FIG. 10 is a view illustrating a black solid image output when on condition that the offset voltage Voff was −1.0 kV and the peak-to-peak voltage Vpp was 5.0 kV.

For reference, a black solid image output under a condition of a DC voltage of −2.5 kV acting as the secondary transfer bias and capable of making the image densities of the recessed portions the highest in the test (in which the secondary transfer bias is composed only of the DC component) shown in Table 2 is shown in FIG. 9. Also, a black solid image output under a condition in which the DC voltage (offset voltage Voff) is −1.0 kV and the peak-to-peak voltage Vpp is 5.0 kV, among the bias conditions shown in FIG. 8, is shown in FIG. 10. It can be seen that, if the superimposed bias is used as the secondary transfer bias, it is possible to significantly improve the reproducibility of the densities of the recessed portions, as compared to a case of using the secondary transfer bias composed only of the DC component.

As an image forming apparatus using a secondary transfer bias composed of a superimposed bias, an image forming apparatus disclosed in Japanese Patent Application Laid-open No. 2006-267486 is known. However, because of the below-mentioned reasons, in this image forming apparatus, it is difficult to obtain Rank 4 or higher with regard to the reproducibility of the densities of the recessed portions. That is, in Japanese Patent Application Laid-open No. 2006-267486, FIG. 5 shows the following test results. That is, on condition that 2.0 kV is used as Vdc corresponding to the DC component of the secondary transfer bias composed of the superimposed bias, 1 kV to 4 kV is used as an AC component Vac, and 2 kHz is used as the frequency f of the AC component, a whited grade corresponding to the reproducibility of the densities of the recessed portions is evaluated. Unlike the printer according to the reference example, the Vdc and Vac are applied to the nip forming roller and the secondary-transfer rear-surface roller is grounded. Then, a DC component having a positive polarity is used as the Vdc, such that the toner is electrostatically drawn from the secondary-transfer rear-surface roller side to the nip forming roller side in the secondary transfer nip so as to be secondarily transferred onto the recording sheet. FIG. 5 of Japanese Patent Application Laid-open No. 2006-267486 shows a graph. This graph represent following: As the AC component Vac gradually increases from 0 kV to 2.0 kV, the whited grade is gradually improved, and when the AC component Vac reaches 2 kV, the whited grade is most materially improved. If the AC component Vac is larger than 2.0 kV, as the AC component Vac increases, the whited grade goes steadily downhill. The maximum value of the Vac shown in the graph is 4 kV, and when the Vac is 4 kV, the whited grade becomes the worst result. In Japanese Patent Application Laid-open No. 2006-267486, whether the AC component Vac is a peak-to-peak voltage or is an amplitude which is half that of the peak-to-peak voltage is not explicitly stated. However, in cases where 'ac' is simply stated, there are many cases representing the latter. Assuming that the Vac is the amplitude, in the test shown in FIG. 5 of Japanese Patent Application Laid-open No. 2006-267486, if the condition on which the Vac is set at 2.0 kV to obtain the best result is replaced with a condition of the printer according to the reference example, the offset voltage Voff becomes −2.0 kV and the peak-to-peak voltage Vpp becomes 4.0 kV. Also, if the condition on which the Vac is set at 4 kV to obtain the worst result is replaced with a condition of the printer according to reference example, the offset voltage Voff becomes −2.0 kV and the peak-to-peak voltage Vpp becomes 8.0 kV. On the basis of these conditions, the inventors of the present invention fixed the DC voltage (offset voltage Voff) of the superimposed bias at −2.0 kV in the print test apparatus, and output the black solid image on recording sheets (SAZANAMI) under each condition while gradually increasing the peak-to-peak voltage Vpp from 1 kV to 8 kV. Then, unlike the results of FIG. 5 of Japanese Patent Application Laid-open No. 2006-267486, results in which the image densities of the recessed portions of the sheet surfaces gradually increased as the Vpp increased from 1 kV to 8 kV were obtained.

Figure 11:
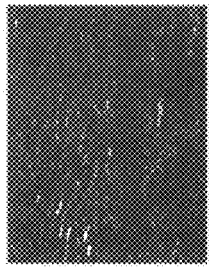
FIG. 11 is a view illustrating a black solid image output when a secondary transfer bias composed only of a DC voltage of −2.0 kV was applied.
Figure 12:
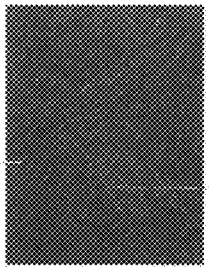
FIG. 12 is a view illustrating a black solid image output when the offset voltage Voff was −2.0 kV and the peak-to-peak voltage Vpp was 4.0 kV.
Figure 13:
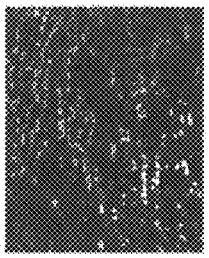
FIG. 13 is a view illustrating a black solid image output when the offset voltage Voff was −2.0 kV and the peak-to-peak voltage Vpp was 8.0 kV.

A black solid image output in the test on condition that the secondary transfer bias was composed only of the DC component of −2.0 kV is shown in FIG. 11. Also, a black solid image output on condition that the secondary transfer bias was composed of the DC voltage (corresponding to the offset voltage Voff in this example) of −2.0 kV and the peak-to-peak voltage Vpp of 4.0 kV is shown in FIG. 12. This condition is the condition on which the best result was obtained in the test disclosed in Japanese Patent Application Laid-open No. 2006-267486. Further, a black solid image output on condition that the secondary transfer bias was composed of the offset voltage Voff of −2.0 kV and the peak-to-peak voltage Vpp of 8.0 kV is shown in FIG. 13. This condition is the condition on which the worst result was obtained in the test disclosed in Japanese Patent Application Laid-open No. 2006-267486. All of the black solid images are 70 mm long and 55 mm wide. If attention is focused on only the reproducibility of the densities of the recessed portions, the best result was obtained in the black solid image shown in FIG. 13 among the three black solid images. This black solid image looks at the first glance like a significant shortage of the image densities at the recessed portions was caused. However, as seen from the fact that whited portions looking like groove-shaped recessed portions are remarkably larger than groove-shaped recessed portions of FIG. 12, the whited portions were generated by the linear connection of a large number of white dots due to the discharge, not to a shortage of the image densities of the recessed portions. The linearly connected white dots were generated along particularly deep recessed portions of the recessed portions of the sheet surface, and at recessed portions shallower than the particularly deep recessed portions, image densities higher than those of the recessed portions of FIG. 12 were obtained. Nevertheless, the image densities thereof were rated as Rank 3 lower than the allowable level.

In the condition in which the Voff is −2.0 kV and the Vpp is 4.0 kV to obtain the black solid image of FIG. 12, if the relation between both voltages is expressed as Equation, Equation of '½×Vpp=|Voff|' is obtained. This condition deviates significantly from the condition of '¼×Vpp=|Voff|' which the inventors of the present invention derived by the second print test (which is also the condition of '¼×Epp=|Eoff|' in the present example). Also, in the condition in which the Voff is −2.0 kV and the Vpp is 8.0 kV to obtain the black solid image of FIG. 13, if the relation between both voltages is expressed as Equation, Equation of '¼×Vpp=|Voff|' is obtained. This condition is close to but deviates slightly from the condition of '¼×Vpp>|Voff|' which the inventors of the present invention derived by the second print test. Under the condition of '¼×Vpp=|Voff|', the reproducibility of the densities of the recessed portions of Rank 3 could be obtained at the most (see FIGS. 8 and 10). From the above, it was found that, in obtaining the reproducibility of the densities of the recessed portions of Rank 4 or higher, a condition of '¼×Vpp>|Voff|' needs to be satisfied.

As described already, in the print test apparatus, since the cored bar of the nip forming roller 36 is grounded while the secondary transfer bias is applied to the cored bar of the secondary-transfer rear-surface roller 33, the DC component potential difference Eoff which is the hourly averaged value of the potential difference between both rollers becomes the same value as the offset voltage Voff which is the DC component of the secondary transfer bias. In a case that a DC voltage is applied to the cored bar of the nip forming roller 36 instead of grounding the cored bar of the nip forming roller 36, a superimposed value of the DC voltage applied to the cored bar of the secondary-transfer rear-surface roller 33 and the DC voltage applied to the cored bar of the nip forming roller 36 is handled as the offset voltage Voff. In other words, even when the DC voltage is applied to the cored bar of the nip forming roller 36 instead of grounding the cored bar of the nip forming roller 36, the DC component potential difference Eoff and the offset voltage Voff become the same value.

As the method of creating a potential difference including a DC component and an AC component between a nip forming member such as the nip forming roller 36 and a rear-surface abutting member such as the secondary-transfer rear-surface roller 33, the following six manners can be exemplified.

(1) A superimposed bias is applied to the nip forming member, and the rear-surface abutting member is connected to the ground.

(2) A superimposed bias is applied to the nip forming member, and a DC bias is applied to the rear-surface abutting member.

(3) An AC bias composed only of an AC component is applied to the nip forming member, and a DC bias is applied to the rear-surface abutting member.

(4) The nip forming member is connected to the ground, and a superimposed bias is applied to the rear-surface abutting member.

(5) A DC bias is applied to the nip forming member, and a superimposed bias is applied to the rear-surface abutting member.

(6) A DC bias is applied to the nip forming member, and an AC bias composed only of an AC component is applied to the rear-surface abutting member.

Next, a transfer test conducted by the inventors of the present invention will be described.

The inventors of the present invention made a special transfer test apparatus, in order to reveal a cause for which the sufficient image densities could be obtained at the recessed portions and a light-and-shade pattern according to the surface roughness could be made less conspicuous than the related art, by satisfying the condition '¼×Vpp>|Voff|'.

Figure 14:
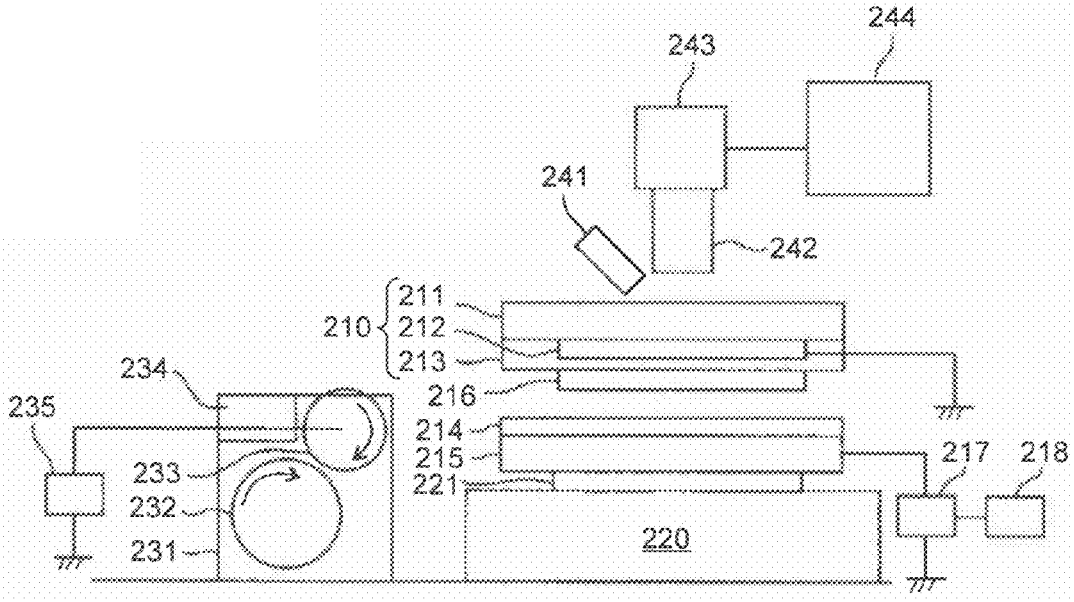
FIG. 14 is a schematic view illustrating a transfer test device used in tests.

FIG. 14 is a schematic diagram illustrating the transfer test apparatus. The transfer test apparatus includes a transparent substrate 210, a developing unit 231, a Z stage 220, a light source 241, a microscope 242, a high-speed camera 243, a personal computer 244, and so on. The transparent substrate 210 includes a glass plate 211, a transparent electrode 212 made of indium tin oxide (ITO) disposed on a lower surface of the glass plate 211, and a transparent insulating layer 213 made of a transparent material covered on the transparent electrode 212. The transparent substrate 210 is supported at a predetermined height position by a substrate supporting unit (not shown). The substrate supporting unit is movable in vertical and horizontal directions in FIG. 14 by a moving mechanism (not shown). In the example shown in FIG. 14, the transparent substrate 210 is located above the Z stage 220 on which a metal plate 215 is mounted. However, the transparent substrate 210 can be moved, by moving the substrate supporting unit, to be directly above the developing unit 231 disposed lateral to the Z stage 220. The transparent electrode 212 of the transparent substrate 210 is connected to an electrode which is fixed to the substrate supporting unit. This fixed electrode is grounded.

The developing unit 231 has the same configuration as the developing unit of the printer according to the reference example, and includes a screw member 232, a developing roller 233, a doctor blade 234, and so on. The developing roller 233 is driven to rotate in a state that a developing bias is applied thereto by means of a power supply 235.

If the transparent substrate 210 moves to a position, which is directly above the developing unit 231 and faces the developing roller 233 with a predetermined gap, at a predetermined speed by the movement of the substrate supporting unit, toner on the developing roller 233 is transferred onto the transparent electrode 212 of the transparent substrate 210. As a result, on the transparent electrode 212 of the transparent substrate 210, a toner layer 216 having a predetermined thickness is formed. The amount of attached toner per unit area relative to the toner layer 216 can be adjusted by a toner concentration of a developer, an charge amount of the toner, a developing bias value, a gap between the substrate 210 and the developing roller 233, a movement speed of the transparent substrate 210, and a rotation speed of the developing roller 233, and so on.

The transparent substrate 210 having the toner layer 216 formed thereon moves in a parallel manner to a position facing a recording sheet 214 attached on the planer metal plate 215 with a conductive adhesive. The metal plate 215 is disposed on a substrate 221 having a load sensor installed therein, and the substrate 221 is disposed on the Z stage 220. Also, the metal plate 215 is connected to a voltage amplifier 217. A transfer bias composed of a DC voltage and an AC voltage is input to the voltage amplifier 217 by a waveform generating unit 218, and the transfer bias amplified by the voltage amplifier 217 is applied to the metal plate 215. If the Z stage 220 is driven to raise the metal plate 215, the recording sheet 214 begins to come into contact with the toner layer 216. When the metal plate 215 is further raised, the pressure onto the toner layer 216 increases. The rise of the metal plate 215 is stopped so that an output of the load sensor becomes a predetermined value. In the state that the pressure is the predetermined value, the transfer bias is applied to the metal plate 215 and the behavior of the toner is observed. After the observation, the Z stage 220 is driven to lower the metal plate 215 so that the recording sheet 214 is detached from the transparent substrate 210. At that time, the toner layer 216 is transferred onto the recording sheet 214.

The observation of the behavior of the toner is performed by using the microscope 242 and the high-speed camera 243 disposed above the substrate 210. Since all layers composing the substrate 210, which are the glass plate 211, the transparent electrode 212, and the transparent insulating layer 213, are totally made of transparent materials the behavior of the toner under the transparent substrate 210 can be observed from the topside of the transparent substrate 210, through the transparent substrate 210.

As the microscope 242, a microscope known as a zoom lens VH-Z75 (manufactured by Keyence Corp.) was used. Also, as the high-speed camera 243, a FASTCAM-MAX 120KC (manufactured by Photron, Inc.) was used. The FASTCAM-MAX 120KC (manufactured by Photron, Inc.) is controllably driven through the personal computer 244. The microscope 242 and the high-speed camera 243 are supported by a camera supporting unit (not shown). The camera supporting unit is configured to be capable of adjusting the focus of the microscope 242.

The behavior of the toner is shot as follows. That is, first, an illumination beam is irradiated from a light source 241 onto an observation point for observing the behavior of the toner and the focus of the microscope 242 is adjusted. Next, the transfer bias is applied to the metal plate 215 so as to move the toner of the toner layer 216 attached to the lower surface of the transparent substrate 210 toward the recording sheet 214. At this time, the behavior of the toner is shot using the high-speed camera 243.

Comparing the transfer test apparatus shown in FIG. 14 with the printer according to the reference example, there is a difference in the configuration of the transfer nip for transferring the toner onto the recording sheet. Therefore, their transfer electric fields acting the toner differ from each other, even with the identical transfer bias. In order to find an appropriate observation condition, even in the transfer test apparatus, the transfer bias condition to obtain good reproducibility of the densities of the recessed portions was examined. As the recording sheet 214, duodecimo paper of LEATHAC 66 (a trade name) (manufactured by Tokush Paper Kabushiki Kaisha) having a ream weight of 260 kg was used. LEATHAC 66 is paper having a higher degree of surface roughness than 'SAZANAMI'. As the toner, a mixture of Y toner having an average grain diameter of 6.8 μm and a small amount of K toner was used. In the transfer test apparatus, since the transfer bias is applied to a rear surface of the recording sheet, the polarity of the transfer bias capable of transferring the toner onto the recording sheet is opposite to that of the printer according to the reference example (that is, a positive polarity). As the AC component of the transfer bias composed of the superimposed bias, an AC component having a sinusoidal waveform was used. The toner layer 216 was transferred onto the recording sheet 214 in an amount of attached toner of 0.4 $mg/cm^2$ to 0.5 $mg/cm^2$, while the peak-to-peak voltage Vpp was changed from 400 V to 2600 V in units of 200 V in a state that the frequency f of the AC component was fixed at 500 Hz and the DC voltage (corresponding to the offset voltage Voff in the present example) was fixed at 200 V. As a result, on condition that the peak-to-peak voltage Vpp was set at 800 V or less, the reproducibility of the densities of the recessed portions became lower than Level 4, but on condition that the Vpp was set within a range of 900 V to 2200 V, the reproducibility of the densities of the recessed portions became Level 4 or higher. Even in the transfer test apparatus, similarly to the print test apparatus, under the condition of '¼×Vpp>Voff', the reproducibility of the densities of the recessed portions could be made up to an allowable level. On condition that the peak-to-peak voltage Vpp was set at 2400 V, the reproducibility of the densities of the recessed portions was an allowable level, but white dots exceeding an allowable level occurred.

Figure 15:
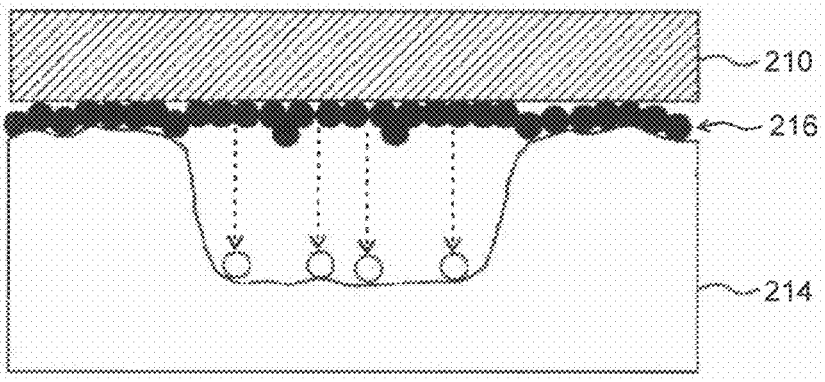
FIG. 15 is an enlarged schematic view illustrating a behavior of toner at a transfer early-stage in a secondary transfer nip.
Figure 16:
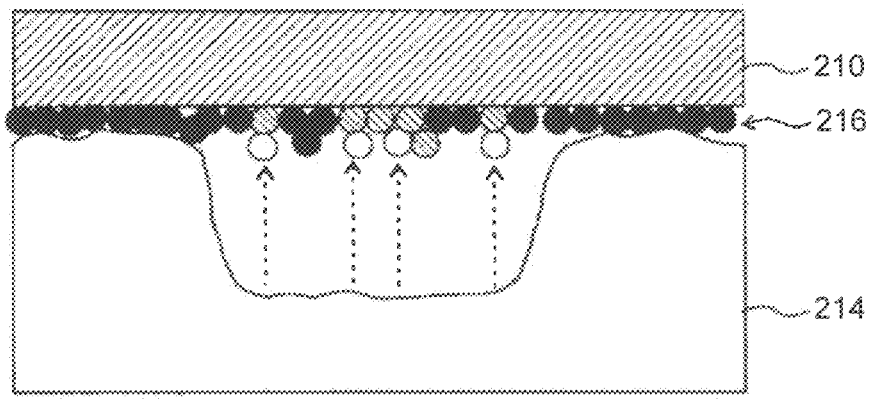
FIG. 16 is an enlarged schematic view illustrating a behavior of toner at a transfer middle-stage in a secondary transfer nip.
Figure 17:
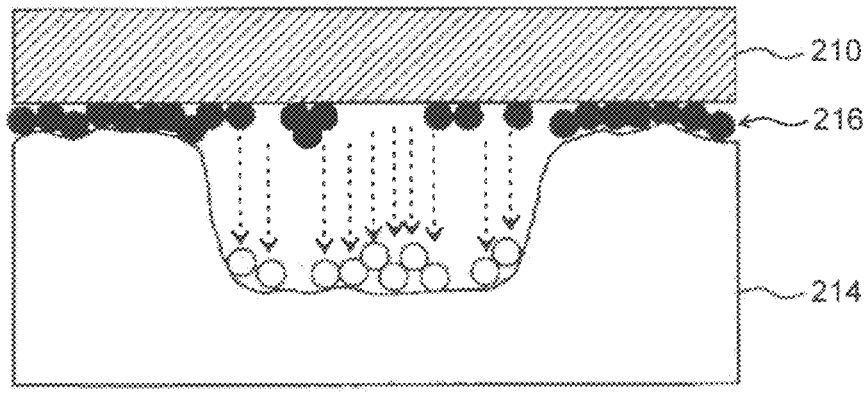
FIG. 17 is an enlarged schematic view illustrating a behavior of toner at a transfer later-stage in a secondary transfer nip.

Next, the microscope 242 was focused on the toner layer 216 on the transparent substrate 210, and the behavior of the toner was shot on condition that the DC voltage (corresponding to the offset voltage Voff in the present example) was set at 200 V and the peak-to-peak voltage Vpp was set at 1000 V, that is, under the condition of '¼×Vpp>|Voff|'. Then, the following phenomenon was observed. That is, toner particles in the toner layer 216 reciprocates between the transparent substrate 210 and the recording sheet 214 by alternating electric fields formed by the AC component of the transfer bias, and as the number of times of the reciprocation increases, the amount of reciprocating toner particles increases. Specifically, in the transfer nip, for every one period (1/f) of the AC component of the transfer bias, the alternating electric fields acts once, such that the toner particles reciprocate once. In the first one period, as shown in FIG. 15, only toner particles existing on the surface of the toner layer 216 escape from the layer. Then, the toner particles enter the recessed portions of the recording sheet 214 and then return to the toner layer 216. At this time, the returned toner particles hit other toner particles of the toner layer 216 such that the adhesion of the hit toner particles to the toner layer 216 and the transparent substrate 210 is weakened. Therefore, in the next one period, as shown in FIG. 16, more toner particles than those in the previous one period escape from the toner layer 216. Then, the toner particles enter the recessed portions of the recording sheet 214, and then return to the toner layer 216 again. At this time, the returned toner particles hit other toner particles still remaining in the toner layer 216 such that the adhesion of the hit toner particles to the toner layer 216 and the transparent substrate 210 is weakened. Therefore, in the next one period, as shown in FIG. 17, further more toner particles than those in the previous one period escape from the toner layer 216. In this way, whenever toner particles reciprocate, the number of toner particles gradually increases. It could be found that, by doing so, a sufficient amount of toner had been transferred when the nip transit time had elapsed (a time corresponding to the nip transit time had elapsed in the transfer test apparatus).

Meanwhile, on condition that the DC voltage was set at 200 V and the peak-to-peak voltage Vpp was set at 800 V, that is, on condition that '¼×Vpp>|Voff|' is not satisfied, the behavior of the toner was shot, and the following phenomenon was observed. That is, among the toner particles of the toner layer 216, toner particles existing on the surface of the layer escaped from the layer and entered the recessed portions of the recording sheet P in the first one period. However, thereafter, the entered toner particles remained in the recessed portions without going toward the toner layer 216. When the next one period came, toner particles that newly escaped from the toner layer 216 and entered the recessed portions were very few. Therefore, at a time point when the nip transit time elapsed, only a small amount of toner particles had been transferred into the recessed portions of the recording sheet P.

As described above, it could be found that the phenomenon as shown in FIGS. 15 to 17 was caused by satisfying the condition of '¼×Vpp>|Voff|', thereby transferring a sufficient amount of toner into the recessed portions of the recording sheet P. Also, in order to cause the phenomenon as shown in FIGS. 15 to 17, it is required to make the toner particles reciprocate at least twice in the transfer nip. For this reason, it is required to set the nip transit time to twice or more the period of the AC component. Preferably, as described already, it is preferable to make the alternating electric fields act 4 times or more in the transfer nip (f>(4/d)×v).

Third Print Test

As the recording sheet P, instead of SAZANAMI, duodecimo paper of LEATHAC 66 (a trade name) (manufactured by Tokush Paper Kabushiki Kaisha) having a ream weight of 260 kg was used. The basis weight of the duodecimo paper of LEATHAC 66 having the ream weight of 260 kg becomes 302 g/m$^2$. Currently, in an electrophotographic image forming apparatus, the maximum paper thickness in design is generally set to a basis weight of 300 g/m$^2$. In other words, the duodecimo paper of LEATHAC 66 having a ream weight of 260 kg is paper having the general maximum paper thickness which the image forming apparatus can handle and a high degree of surface roughness like the Japanese paper. On condition that the peak-to-peak voltage Vpp was set at 6 kV and the offset voltage Voff was set at 1 kV, a print test was conducted by using the duodecimo paper of LEATHAC 66 having the ream weight of 260 kg. This print test satisfies the above-mentioned condition of '¼×Vpp>|Voff|'. Nevertheless, sufficient image densities could not be obtained at some of the recessed portions of the sheet surface. Causes for which there is a difference from the second print test were only the paper thickness or a depth of the roughness. From this, it could be found that, even when the peak-to-peak voltage Vpp is set higher than four times the absolute value of the offset voltage Voff, if a sheet having a comparatively large thickness or a comparatively high degree of surface roughness is used as the recording sheet P, sufficient image densities are not obtained at the recessed portions on the sheet surface.

Fourth Print Test

Next, black solid images were tested under various potential conditions by using the duodecimo paper of LEATHAC 66 having the ream weight of 260 kg. The frequency f of the AC component of the superimposed bias was fixed at 500 Hz. Also, the process linear velocity v was fixed at 282 mm/s. Results of evaluation on the reproducibility of the densities of the recessed portions of the black solid images are shown in the following Table 6.

TABLE 6

| Reproducibility of Densities of Recessed Portions | | Vpp [kV] 6 | 6.5 | 7 | 7.5 | 8 | 8.5 | 9 | |
|---|---|---|---|---|---|---|---|---|---|
| Voff [kV] | −1.7 | 1 | 1 | 1 | 2 | 2 | 2 | 3 | Rated rank |
| | −1.6 | 1 | 1 | 1 | 2 | 2 | 3 | 3 | |
| | −1.5 | 1 | 1 | 2 | 2 | 3 | 3 | 4 | |
| | −1.4 | 1 | 2 | 2 | 2 | 3 | 4 | 4 | |
| | −1.3 | 1 | 2 | 2 | 3 | 4 | 4 | 5 | |
| | −1.2 | 2 | 2 | 3 | 4 | 4 | 5 | 5 | |
| | −1.1 | 2 | 3 | 4 | 4 | 5 | 5 | 5 | |
| | −1 | 3 | 4 | 4 | 5 | 5 | 5 | 5 | |
| | −0.9 | 4 | 4 | 5 | 5 | 5 | 5 | 5 | |

Similarly to the second print test, the reproducibility of the densities of the recessed portions tends to advance in rank as the peak-to-peak voltage Vpp of the AC component increases, and advance in rank as the absolute value of the offset voltage Voff decreases. However, in order to obtain Rank 4 or higher, it was required to make a ratio of the peak-to-peak voltage Vpp to the offset voltage Voff larger than that in the second print test.

Results of evaluation on the reproducibility of the densities of the protruding portions of the black solid images are shown in the following Table 7.

TABLE 7

| Reproducibility of Densities of Protruding Portions | | Vpp [kV] 6 | 6.5 | 7 | 7.5 | 8 | 8.5 | 9 | |
|---|---|---|---|---|---|---|---|---|---|
| Voff [kV] | −1.7 | 5 | 5 | 5 | 5 | 5 | 5 | 5 | Rated rank |
| | −1.6 | 5 | 5 | 5 | 5 | 5 | 5 | 5 | |
| | −1.5 | 5 | 5 | 5 | 5 | 5 | 5 | 5 | |
| | −1.4 | 5 | 5 | 5 | 5 | 5 | 5 | 5 | |
| | −1.3 | 5 | 5 | 5 | 5 | 5 | 5 | 5 | |
| | −1.2 | 5 | 5 | 5 | 5 | 5 | 5 | 5 | |
| | −1.1 | 4 | 4 | 4 | 4 | 4 | 4 | 4 | |

TABLE 7-continued

| Reproducibility of Densities of Protruding Portions | Vpp [kV] | | | | | | |
|---|---|---|---|---|---|---|---|
| | 6 | 6.5 | 7 | 7.5 | 8 | 8.5 | 9 |
| −1 | 3 | 3 | 3 | 3 | 3 | 3 | 3 |
| −0.9 | 1 | 1 | 1 | 1 | 1 | 1 | 1 |

Similarly to the second print test, the image densities of the protruding portions (smooth portions) tended to increase as the absolute value of the offset voltage Voff increased.

Results of evaluation on the appearance of white dots of the black solid images are shown in the following Table 8.

TABLE 8

| Appearance of White Dots | | Vpp [kV] | | | | | | | |
|---|---|---|---|---|---|---|---|---|---|
| | | 6 | 6.5 | 7 | 7.5 | 8 | 8.5 | 9 | |
| Voff [kV] | −1.7 | 5 | 5 | 5 | 4 | 4 | 4 | 3 | Rated rank |
| | −1.6 | 5 | 5 | 5 | 4 | 4 | 4 | 3 | |
| | −1.5 | 5 | 5 | 5 | 5 | 4 | 4 | 3 | |
| | −1.4 | 5 | 5 | 5 | 5 | 4 | 4 | 3 | |
| | −1.3 | 5 | 5 | 5 | 5 | 4 | 4 | 3 | |
| | −1.2 | 5 | 5 | 5 | 5 | 4 | 4 | 3 | |
| | −1.1 | 5 | 5 | 5 | 5 | 4 | 4 | 3 | |
| | −1 | 5 | 5 | 5 | 5 | 4 | 4 | 3 | |
| | −0.9 | 5 | 5 | 5 | 5 | 4 | 4 | 3 | |

Similarly to the second print test, the appearance of white dots due to the discharge tended to be suppressed as the peak-to-peak voltage Vpp of the AC component decreased. Also, the appearance of white dots due to the discharge tended to be suppressed as the absolute value of the offset voltage Voff decreased.

Figure 20:
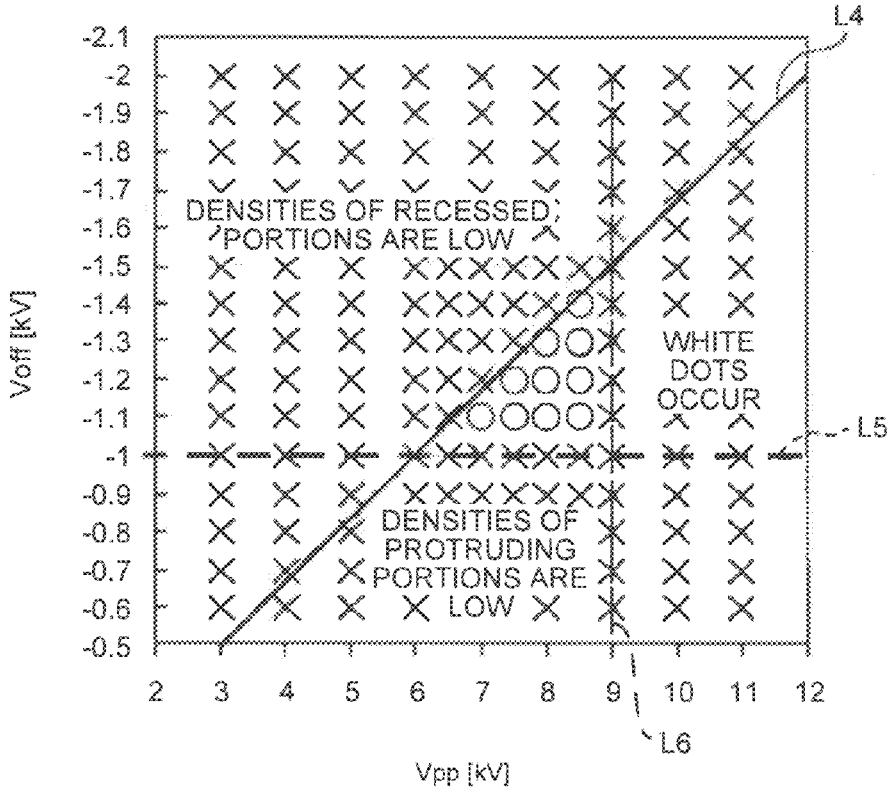
FIG. 20 is a graph illustrating the relation among the offset voltage Voff, the peak-to-peak voltage Vpp, the reproducibility of the densities of the recessed portions, the reproducibility of the densities of the protruding portions, and the appearance of white dots, made on the basis of a result of a fourth print test.

FIG. 20 is a graph illustrating the relation among the offset voltage Voff, the peak-to-peak voltage Vpp, the reproducibility of the densities of the recessed portions, the reproducibility of the densities of the protruding portions, and the appearance of the white dots, made on the basis of a result of a fourth print test. In a two-dimensional coordinate system shown in FIG. 20, in an area on a straight line L4 and in an area having y coordinates larger than the straight line L4 at the same x coordinates as the straight line L4, results in which the ranks of the reproducibility of the densities of the recessed portions were 3 or less lower than 4 which was the allowable level (the low densities of the recessed portions were noticeable) were obtained. For this reason, plotted points are shown by 'x'. Also, in an area on a straight line L5 and in an area having y coordinates larger than the straight line L5, results in which the ranks of the reproducibility of the densities of the protruding portions were 3 or less lower than 4 which was the allowable level (the low densities of the protruding portions were noticeable) were obtained. For this reason, plotted points are shown by 'x'. Further, in an area on a straight line L6 and in an area having y coordinates larger than the straight line L6 at the same x coordinates as the straight line L6, results in which the ranks of the appearance of white dots were 3 or less lower than 4 which was the allowable level (white dots due to the discharge were noticeable) were obtained. For this reason, plotted points are shown by 'x'. Also, in FIG. 20, in an area upper than the straight line L4 and lower than the straight line L5, the ranks of the reproducibility of the densities of the recessed portions were lower than 4, and the ranks of the reproducibility of the densities of the protruding portions were lower than 4. Further, in FIG. 20, in an area upper than the straight line L4 and upper than the straight line L6, the ranks of the reproducibility of the densities of the recessed portions were lower than 4 and the ranks of the appearance of white dots were lower than 4. Furthermore, in FIG. 20, in an area lower than the straight line L5 and upper than the straight line L6, the ranks of the reproducibility of the densities of the protruding portions were lower than 4 and the ranks of the appearance of white dots were lower than 4.

In FIG. 20, only test results in which all of the three items, (i) the reproducibility of the densities of the recessed portions, (ii) the reproducibility of the densities of the protruding portions, and (iii) the appearance of white dots were rated as Rank 4 or higher which were allowable levels are shown by circles. If attention is focused on only the reproducibility of the densities of the recessed portions, not the three items, when combinations of the offset voltages Voff and the peak-to-peaks voltage Vpp having coordinates lower than the straight line L4 are used, the reproducibility of the densities of the recessed portions becomes better. The straight line L4 is represented as Equation of '$Vpp=-6\times Voff$'. Therefore, if the secondary transfer bias satisfying a condition of '$\frac{1}{6}\times Vpp>|Voff|$' is used, even in LEATHAC 66 having the ream weight of 260 kg, sufficient image densities can be obtained at the recessed portions of the sheet surface.

Figure 21:
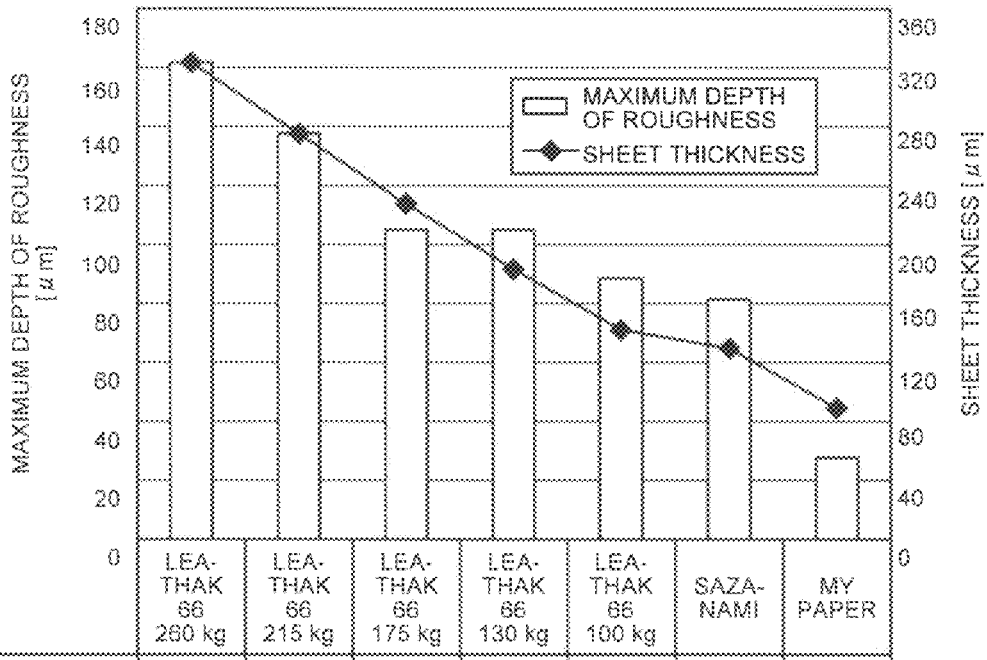
FIG. 21 is a graph illustrating a relation among the kind of sheet, the thickness of the sheet, and a maximum depth of the roughness of a surface of the sheet.

FIG. 21 is a graph illustrating a relation among the kind of sheet, the thickness of the sheet, and a maximum depth of the roughness of a surface of the sheet. In the kinds of sheets shown in FIG. 21, both of LEATHAC 66 and SAZANAMI are Japanese paper type sheets having noticeable surface roughness. Also, My Paper is a plain paper type sheet having a very low degree of surface roughness and is shown for comparative reference together with the Japanese paper type sheets. As shown in FIG. 21, it can be seen that, as the sheet thickness increases, the maximum depth of the roughness of the sheet surface also increases. It can be seen that LEATHAC 66 having the ream weight of 260 kg is the sheet kind which is the largest in the sheet thickness and the maximum depth of the roughness among seven kinds of sheets. Also, as described above, LEATHAC 66 having the ream weight of 260 kg is the sheet kind corresponding to the maximum thickness (a basis weight is 300 g/m$^2$) in design in a general electrophotographic image forming apparatus. In other words, LEATHAC 66 having the ream weight of 260 kg is a sheet which has the maximum sheet thickness applicable to a general electrophotographic image forming apparatus and is the largest in the maximum depth of the roughness. Therefore, under any condition of '$\frac{1}{6}\times Vpp>|Voff|$' on which good reproducibility of the densities of the recessed portions is obtained in LEATHAC 66 having the ream weight of 260 kg, regardless of the kinds of sheets, sufficient image densities can be obtained at the recessed portions on the surface.

As a measuring apparatus for measuring the maximum depth of the roughness, 'SURFCOM 1400D', manufactured by Tokyo Seimitsu Co., Ltd., was used. As for measurement points, the surface of a recording sheet was observed with a microscope and five points to be areas to be tested were selected at random from the entire surface. With respect to each of the points, the maximum cross-section height Pt (JIP B 0601: 2001) of a cross-section curve was measured on condition that the an evaluation length was set at 20 mm and a reference length was set at 20 mm. Then, among the obtained five maximum cross-section heights Pt, an average value of the top three was obtained. The above processes were performed on the same kind of three recording sheets, and an average of average values of the three sheets was obtained as the maximum depth of the roughness.

Next, a characteristic configuration of a printer according to a first embodiment will be described. Unless otherwise stated, the configuration of the printer according to the first embodiment is the same as that of the printer according to the reference example. In the printer according to the first embodiment, the condition of '⅙×Vpp>|Voff|' is provided as the potential difference between the cored bar of the secondary-transfer rear-surface roller 33 and the cored bar of the nip forming roller 36, and the secondary transfer bias power supply 39 is configured as a potential difference generating unit to apply the secondary transfer bias such that the potential of the cored bar of the nip forming roller 36 is larger than the potential of the cored bar of the secondary-transfer rear-surface roller 33 on the opposite polarity side to the charged polarity of the toner. Therefore, as the inventors clarified in the tests, regardless of the thickness and the maximum depth of the roughness of the recording sheet P, it is possible to make a light-and-shade pattern according to the surface roughness of the sheet hardly noticeable as compared to the related art. Here, the secondary transfer bias is for causing the potential difference in any one of the above-mentioned six manners, and includes not only a bias applied to only any one of the secondary-transfer rear-surface roller 33 and the nip forming roller 36 but also biases respectively applied to both sides.

Also, in the printer according to the first embodiment, the frequency f of the AC component of the secondary transfer bias, the nip width d [mm] of the secondary transfer nip, and the process linear velocity v which is the belt surface movement velocity are set such that a condition of 'f [Hz]>(4/d)×v' is satisfied. This setting makes it possible to prevent occurrence of the pitch irregularity, as described already.

In the print test apparatus used in the test, a toner image potential Vtoner which is the potential of a single-color solid toner image (1 cm×1 cm) during power-up is about −80 V. It is required to make the absolute value of the offset voltage Voff larger than the toner image potential Vtoner.

The toner image potential Vtoner can be obtained as follows. That is, in a case of forming a black toner image, the surface potential of a black solid image is referred to as the toner image potential Vtoner. Here, the black solid image is an image in which each pixel of the entire area of 1 cm×1 cm has a black pixel value. The black solid image has the same image structure as a solid image obtained by printing an all-black image made in a monochrome grayscale mode with Photoshop (a registered trademark), which is image software manufactured by Adobe Systems Inc., from a PostScript correspondence printer driver. Meanwhile, in a case of forming a color image, a surface potential of a toner layer on the belt when a two-color solid image with superimposed magenta and cyan is overlappingly transferred onto the intermediate transfer belt 31 is referred to as the toner image potential Vtoner. In this case, the two-color solid image is an image having the same image structure as a toner image (the same laser writing) when a superimposed image of an all-magenta image and an all-cyan image made in a CMYK color mode with Photoshop manufactured by Adobe Systems Inc. is printed. A reason for making the two-color solid image have the same image structure as the solid image made with Photoshop manufactured by Adobe Systems Inc. is that PostScript is the most general data standard used for DTP and the like.

The white dots due to the discharge occur when the peak-to-peak voltage Vpp is relatively large and |Voff| is relatively large. This corresponds to a case that a peak value Vt (see FIG. 3) having a polarity for moving the toner from the intermediate transfer belt 31 side to the recording sheet P is relatively large. It can be considered that the peak value Vt expressed as Equation of '|Vt|=|Voff|+|Vr|' is associated with occurrence of the white dots due to the discharge. From FIG. 3, in a case that the polarities of the Vt and the Voff are negative, since 'Vt=−½×Vpp+Voff' is satisfied, a relation of 'Voff=½×Vpp+Vt' is established. Meanwhile, since the straight line L3 shown in FIG. 8 is expressed as Equation of 'Voff=½×Vpp−4.55', it can be said that noticeable white dots are generated in an area in which the Vt is −4.55 kV or greater.

The inventors of the present invention checked generated voltages of abnormal images caused by discharge under a plurality of conditions having the minimum Voffmin of the Voff of an area in which good images are obtained, and, as a result, found that the Vt is associated with the occurrence of the white dots due to the discharge, as expected, and the maximum Vtmax and the minimum Voffmin of the peak value Vt capable of keeping the occurrence of the white dots at an allowable level is represented as a relational expression of 'Vtmax=1.7×Voffmin−3.1'. Considering a case of using toner having a positive polarity as the toner, it is preferable to satisfy a relational expression of '|Vtmax|=1.7×|Voffmin|+3.1' which is a modification of the above-mentioned relational expression.

Further, in the printer according to the first embodiment, the secondary transfer bias power supply 39 is configured to apply a bias satisfying the relational expression of '|Vtmax|=1.7×|Voffmin|+3.1' as the secondary transfer bias.

In the present invention, the volume resistivities and resistances of the intermediate transfer belt 31, the secondary-transfer rear-surface roller 33, and the nip forming roller 36 are not limited to those of the first embodiment. However, if the resistances are excessively high, since charge given to the surfaces of the members by discharge or the like is accumulated and the electric field changes with time, it is not preferable. In a case that a unit for removing the charge is not provided, it is preferable to use members having volume resistivities of $1\times10^{12}$ Ω·cm or less as the intermediate transfer belt 31, the secondary-transfer rear-surface roller 33, and the nip forming roller 36.

In non-contact transfer using a corotron or the like which does not form a nip, a condition of '⅙×Vpp>(hourly averaged value of wire potential difference)' similar to the condition of '⅙×Vpp>|Voff|' may be satisfied. However, the case of the corotron is completely different from the present invention in that an AC component is used for only generating ions from wires and reciprocation of toner as described above does not occur. The inventors of the present invention conducted the followings so as to confirm that reciprocation of toner does not occur in the non-contact transfer of the corotron or the like. That is, a PET film having one side with an aluminum layer deposited thereon was prepared. The PET film was disposed on the corotron with the aluminum surface facing a toner side (intermediate transfer belt side), and a change of the potential of the aluminum layer with time was measured. The potential of the aluminum layer was measured by using Model 344 that was a surface electrometer manufactured by Trek Inc. As a result, any change of the potential supporting reciprocation of toner was not confirmed.

Until now, the example in which the secondary transfer nip is formed by bringing the intermediate transfer belt 31 and the nip forming roller 36 into contact with each other has been described. However, the secondary transfer nip may be formed by bringing the intermediate transfer belt 31 and an endless nip forming belt into contract with each other. In this case, between the cored bar of the secondary-transfer rear-surface roller 33 disposed on the inside of the loop of the intermediate transfer belt 31 and a cored bar of a pressing roller which is a pressing member pressing the nip forming belt toward the intermediate transfer belt 31 on the inside of a loop of the nip forming belt, a potential difference may be generated to satisfy the condition of '⅙×Vpp>|Voff|' and to make a potential of the cored bar of the pressing roller larger than the potential of the cored bar of the secondary-transfer rear-surface roller 33 on the opposite polarity side to the charged polarity of the toner.

Also, the example in which the present invention is applied to the secondary transfer nip formed by bringing the intermediate transfer belt 31 which is an image carrier and the nip forming roller 36 which is a nip forming member into contact with each other has been described. However, it is possible to apply the present invention to a transfer nip which is formed by bringing a rear-surface abutting member into contact with a rear surface of an endless-belt-shaped photosensitive element which is an image carrier, pressing the rear-surface abutting member toward the endless-belt-shaped photosensitive element, and bringing the photosensitive element into contact with a nip forming member, and feeding a recording material through there so as to transfer an image on the photosensitive element onto the recording material.

Figure 18:
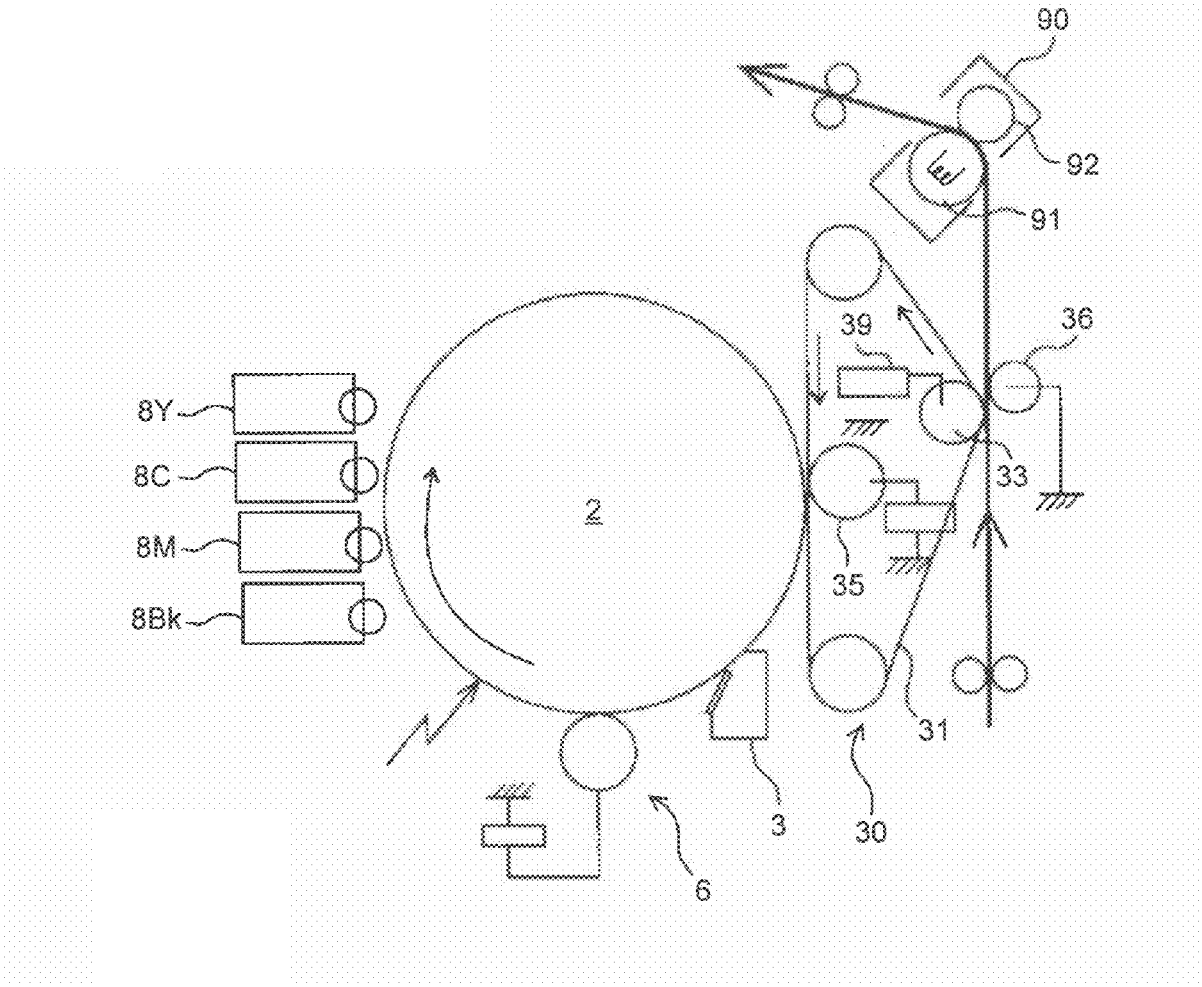
FIG. 18 is a schematic view illustrating a printer according to a modification.

The present invention can also be applied to a secondary transfer nip of a printer having the configuration as shown in FIG. 18. This printer includes developing units 8Y, 8M, 8C, and 8Bk for Y, M, C, and Bk around one photosensitive element 2. In a case of performing image formation, first, the surface of the photosensitive element 2 is uniformly charged by a charging unit 6, and then a laser beam modulated on the basis of image data for Y is irradiated onto the surface of the photosensitive element 2, thereby forming an electrostatic latent image for Y on the surface of the photosensitive element. Then, the Y electrostatic latent image is developed by a developing unit 8Y, so as to obtain a Y toner image, which is primarily transferred onto the intermediate transfer belt 31. Next, transfer residual toner on the surface of the photosensitive element 2 is removed by a drum cleaning unit 3, and then the surface of the photosensitive element 2 is uniformly recharged by the charging unit 6. Next, a laser beam modulated on the basis of image data for M is irradiated onto the surface of the photosensitive element 2, thereby forming an electrostatic latent image for M on the surface of the photosensitive element 2. Then, the M electrostatic latent image is developed by a developing unit 8M, so as to obtain an M toner image. Then, the M toner image is primarily transferred to overlap the Y toner image on the intermediate transfer belt 31. Thereafter, in the same way, a C toner image and a K toner image obtained through development on the photosensitive element 2 are sequentially primarily transferred to be superimposed on the YM toner image on the intermediate transfer belt 31. As a result, a four-color superimposed toner image is formed on the intermediate transfer belt 31.

Next, the four-color superimposed toner image on the intermediate transfer belt 31 is secondarily transferred onto a surface of a recording sheet at the secondary transfer nip at once, whereby a full-color image is formed on the recording sheet. Then, the full-color image is fixed to the recording sheet by a fixing unit 90, and then the recording sheet is discharged to the outside of the apparatus.

In the printer having the above-mentioned configuration, the secondary transfer bias power supply 39 may be configured like that of the reference example.

The examples in which the present invention is applied to the electrophotographic printers have been described. However, the present invention can also be applied to an image forming apparatus for forming an image by a toner scattering type. This toner scattering type is a type that directly attaches toner groups scattered in dots from a toner scattering device to a recording sheet or an intermediate recording element without using a latent-image carrier, thereby directly forming a toner image on the recording sheet or the intermediate recording element. The toner scattering type is used for an image forming apparatus disclosed Japanese Patent Application Laid-open No. 2002-307737 and the like. The present invention can be applied to a transfer nip for transferring the toner image from the intermediate recording element which is an image carrier to the recording sheet.

Next, a printer according to a second embodiment will be described. Unless otherwise stated, the configuration of the printer according to the second embodiment is the same as that of the printer according to the first embodiment.

Figure 19:
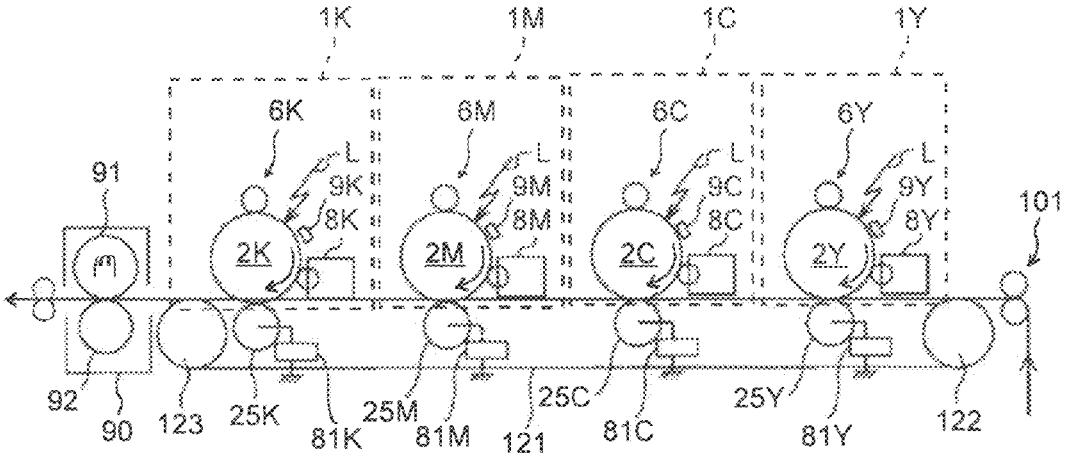
FIG. 19 is a schematic view illustrating a printer according to a second embodiment.

FIG. 19 is a schematic view illustrating the printer according to the second embodiment. This printer is different from the printer according to the first embodiment in that, as a nip forming member, instead of the intermediate transfer belt, an endless sheet feed belt 121 is in contact with photosensitive elements 2Y, 2M, 2C, and 2K of individual colors. In FIG. 19, the symbols 122 and 123 represent supporting rollers. The sheet feed belt 121 endlessly moves to pass a recording sheet carried on a surface thereof through transfer nips for Y, M, C, and K in turn. In this process, Y, M, C, and K toner images on the photosensitive elements 2Y, 2M, 2C, and 2K are overlappingly transferred onto a surface of the recording sheet.

Image forming units 1Y, 1M, 1C, and 1K are provided with potential sensors 9Y, 9M, 9C, and 9K for detecting potentials of electrostatic latent images formed on the photosensitive elements 2Y, 2M, 2C, and 2K by irradiation with laser beams L. The potential sensors 9Y, 9M, 9C, and 9K may be surface potential sensors (EFS-22D) manufactured by TDK Corp., and are disposed to face the surfaces of the photosensitive elements 2Y, 2M, 2C, and 2K with gaps of about 4 mm.

Inside a loop of the sheet feed belt 121, transfer rollers 25Y, 25M, 25C, and 25K for Y, M, C, and K are in contact with the rear surface of the sheet feed belt 121 and press the sheet feed belt 121 toward the photosensitive elements 2Y, 2M, 2C, and 2K. In the printer according to the second embodiment, with respect to the individual colors of Y, M, C, and K, potential difference generating units are configured to include charging units 6Y, 6M, 6C, and 6K for uniformly charging the photosensitive elements 2Y, 2M, 2C, and 2K, optical writing units (not shown) for performing optical writing on the surface of the above-mentioned uniformly charged elements, and the transfer rollers 25Y, 25M, 25C, and 25K, and to generate potential differences including DC components and AC components between latent images on the photosensitive elements and cored bars of the transfer rollers which are pressing members.

Instead of bringing the sheet feed belt 121 into contact with the photosensitive elements 2Y, 2M, 2C, and 2K, the transfer rollers 25Y, 25M, 25C, and 25K may be brought into contact directly with the photosensitive elements 2Y, 2M, 2C, and 2K so as to form primary transfer nips. In this case, the transfer rollers 25Y, 25M, 25C, and 25K act as nip forming members.

Transfer bias power supplies 81Y, 81M, 81C, and 81K are configured to output transfer biases for generating potential differences between the electrostatic latent images on the photosensitive elements 2Y, 2M, 2C, and 2K and the cored bars of the transfer rollers 25Y, 25M, 25C, and 25K. The potential differences satisfy the relation of '⅙×Vpp>|Voff|' between the peak-to-peak voltages Vpp [V] of the AC components and the offset voltages Voff which are hourly averaged values of the potential differences, and make the potentials of the cored bars of the transfer rollers 25Y, 25M, 25C, and 25K larger than the potentials of the electrostatic latent images on the photosensitive elements 2Y, 2M, 2C, and 2K on the opposite polarity side to the charged polarity of the toner.

In this printer, a control unit is configured to perform a latent image potential measuring process as described below at a predetermined timing, for example, immediately after power-up, during standby, or when a continuous print operation is temporally stopped. In the latent image potential measuring process, first, patch-shaped electrostatic latent images having a size of 1 cm by 1 cm are formed on the photosensitive elements 2Y, 2M, 2C, and 2K, and the potentials of the patch-shaped electrostatic latent images are detected by the potential sensors 9Y, 9M, 9C, and 9K. Then, the detection results are stored in a data storing unit such as a RAM. The transfer bias power supplies 81Y, 81M, 81C, and 81K calculate the potential differences, which make relation of '⅙× Vpp>|Voffl' be satisfied and make the potentials of the cored bars of the transfer rollers larger than the potentials of the electrostatic latent images on the photosensitive elements on the opposite polarity side to the charged polarity of the toner, on the basis of the potentials of the patch-shaped electrostatic latent images of Y, M, C, and K transmitted from the control unit. Then, the transfer bias power supplies 81Y, 81M, 81C, and 81K output transfer biases (superimposed biases) to make it possible to obtain the calculation results.

The embodiments described above are merely illustrative, and the present invention has specific effects for each of the following aspects.

Aspect A

In an aspect A, as an image carrier, an intermediate transfer element such as an intermediate transfer belt which faces a latent image carrier such as a photosensitive element and on which a toner image developed on the latent image carrier is primarily transferred is used. Also, as a nip forming member, the nip forming roller 36 or the like is used which is in contact with a front surface of the intermediate transfer element so as to form a secondary transfer nip together with the intermediate transfer element. Further, as a first member, a rear-surface abutting member such as the secondary-transfer rear-surface roller 33 or the like being in contact with a rear surface of the intermediate transfer element at a secondary transfer nip is used. Furthermore, the nip forming member is also used as a second member. With this configuration, between the nip forming member and the intermediate transfer element, regardless of the thickness and maximum depth of a recording sheet P, sufficient image densities can be obtained at recessed portions on the surface of the sheet.

Aspect B

In an aspect B, a transfer bias applying unit such as the secondary transfer bias power supply 39 is configured to apply, as a transfer bias, a bias satisfying a relation of 'f>(4/d)×v' among a frequency f [Hz] of an AC component, a nip width d [mm] which is a contact length of an image carrier and the nip forming member in a surface movement direction of the image carrier at the transfer nip, or a contact length of an intermediate transfer element and the nip forming member in a surface movement direction of the intermediate transfer element at a secondary transfer nip, and a surface movement velocity v [mm/s] of the image carrier or the intermediate transfer element. With this configuration, as described above, it is possible to obtain good images without pitch irregularity.

Aspect C

In an aspect C, there are provided a nip forming member being in contact with a front surface of an image carrier such as an intermediate transfer belt so as to form a transfer nip, a rear-surface abutting member such as the secondary-transfer rear-surface roller 33 being in contact with a rear surface of the image carrier, and a voltage output unit such as the secondary transfer bias power supply 39 outputting a voltage to cause a potential difference including a DC component and an AC component between the nip forming member or a pressing member pressing the nip forming member toward the image carrier, and the rear-surface abutting member by the output voltage therefrom. Then, a toner image carried on a front surface of the image carrier is transferred to a recording sheet inserted into the transfer nip. Even in this configuration, regardless of the thickness and maximum depth of the roughness of a recording sheet, sufficient image densities can be obtained at recessed portions on the surface of the sheet.

Aspect D

In an aspect D, the potential difference is caused between a cored bar of the nip forming member or a cored bar of the pressing member pressing the nip forming member toward the image carrier, and a cored bar of the rear-surface abutting member, in the aspect C. With this configuration, in a recording sheet on which the toner image is transferred therebetween, regardless of the thickness and maximum depth of the roughness of the sheet, sufficient image densities can be obtained at recessed portions on the surface of the sheet.

Aspect E

An aspect E uses an intermediate transfer element having a front surface on which a toner image developed on a surface of a latent image carrier such as a photosensitive element is primarily transferred, as the image carrier in the aspect C or the aspect D. Also, as the nip forming member, the nip forming roller 36 or the like being in contact with the front surface of the intermediate transfer element so as to form a secondary transfer nip is used. Further, a voltage output from a voltage output unit such as the secondary transfer bias power supply 39 is applied to at least any one of (i) a rear-surface abutting member such as the secondary-transfer rear-surface roller 33 being in contact with the rear surface of the intermediate transfer element and (ii) the nip forming member, thereby causing the potential difference. Even in this configuration, as for a recording sheet on which the toner image is transferred between the intermediate transfer element and the nip forming member, regardless of the thickness and maximum depth of the roughness of the sheet, sufficient image densities can be obtained at recessed portions on the surface of the sheet.

Aspect F

In an aspect F, a voltage output unit such as the secondary transfer bias power supply 39 is configured to output a voltage satisfying a relation of 'f>(4/d)×v' among a frequency f [Hz] of an AC component, a nip width d [mm] which is a contact length of an image carrier and the nip forming member in a surface movement direction of the image carrier at the transfer nip, or a contact length of an intermediate transfer element and the nip forming member in a surface movement direction of the intermediate transfer element at a secondary transfer nip, and a surface movement velocity v [mm/s] of the image carrier or the intermediate transfer element, as the voltage in any one of the aspects C, D, and E. With this configuration, as described above, it is possible to obtain good images without pitch irregularity.

According to the invention, as clarified by the inventors through tests, sufficient image densities can be obtained at recessed portions of a surface of a recording member.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A transfer device comprising:

an image carrier to carry a toner image;

a nip forming member that forms a transfer nip between the nip forming member and the image carrier by contacting with a front surface of the image carrier; and a transfer bias applicator that applies a transfer bias, thereby transferring the toner image carried on the image carrier to a recording material at a position of the transfer nip, wherein the transfer bias applicator applies the transfer bias in which an AC component and a DC component are superimposed and in which a peak-to-peak voltage of the AC component is larger than 6 times an absolute value of a voltage of the DC component and smaller than 9 times the absolute value of the voltage of the DC component.

2. The transfer device according to claim 1, wherein the transfer bias applicator is configured to apply a bias for causing a potential difference including an AC component and a DC component as the transfer bias between a first member and a second member, the first member positioned closer to the image carrier than a recording material inserted into the transfer nip, and the second member positioned closer to the nip forming member than the recording member, the potential difference satisfies a relation of '$\frac{1}{6}\times Epp>|Eoff|$' between a potential difference Eoff of a DC component of the second member with respect to the first member and a peak-to-peak potential difference Epp of an AC component of the second member with respect to the first member, and a polarity of the potential difference Eoff is opposite to a charged polarity of toner.

3. The transfer device according to claim 2, wherein the image carrier is an intermediate transfer element which faces a latent image carrier and to which a toner image obtained through development performed on the latent image carrier is primarily transferred, the nip forming member is in contact with a front surface of the intermediate transfer element so as to form a secondary transfer nip together with the intermediate transfer element, the first member is a rear-surface abutting member which is in contact with a rear surface of the intermediate transfer element at the secondary transfer nip, and the second member is the nip forming member.

4. The transfer device according to claim 3, wherein the transfer bias applicator is configured to apply, as the transfer bias, a bias satisfying a relation of '$f>(4/d)\times v$', where a frequency of the AC component is f [Hz], a nip width is d [mm], and a surface movement velocity of the image carrier or the intermediate transfer element is v [mm/s], the nip width being a contact length of an image carrier and the nip forming member in a surface movement direction of the image carrier at the transfer nip, or being a contact length of an intermediate transfer element and the nip forming member in a surface movement direction of the intermediated transfer element at the secondary transfer nip.

5. An image forming apparatus comprising a transfer device according to claim 1, wherein the transfer device transfers the toner image carried on the surface of the image carrier or a latent image carrier to the recording material inserted into the transfer nip formed by contact of the image carrier and the nip forming member, or a transfer nip formed by contact of the latent image carrier and the nip forming member.

6. A transfer device comprising:

a nip forming member that forms a transfer nip by contacting with a front surface of an image carrier;

a rear-surface abutting member that contacts with a rear surface of the image carrier; and a voltage output device that outputs a voltage to generate a potential difference including a DC component and an AC component between the rear-surface abutting member and the nip forming member or a pressing member, the pressing member pressing the nip forming member toward the image carrier, wherein a toner image carried on a front surface of the image carrier is transferred to a recording material inserted into the transfer nip, wherein the voltage output device is configured to output, as the voltage, a voltage satisfying a relation of '$\frac{1}{6}\times Vpp>|Voff|>\frac{1}{9}\times Vpp$' between a peak-to-peak voltage Vpp [V] of an AC component and an offset voltage Voff [V] which is an hourly averaged value of a potential, and wherein as the offset voltage Voff, generated is a voltage that causes a potential of the nip forming member or the pressing member to be larger than a potential of the rear-surface abutting member on an opposite polarity side to a charged polarity of toner.

7. The transfer device according to claim 6, wherein the potential difference is a potential difference between a cored bar of the nip forming member or a cored bar of a pressing member, the pressing member pressing the nip forming member toward the image carrier, and a cored bar of the rear-surface abutting member.

8. The transfer device according to claim 6, wherein as the image carrier, an intermediate transfer element having a front surface to which a toner image developed on a surface of the latent image carrier is primarily transferred is used, as the nip forming member, a nip forming member for forming a secondary transfer nip by contacting with the front surface of the intermediate transfer element is used, and the potential difference is generated by applying a voltage from the voltage output device to at least any one of (i) the rear-surface abutting member for contacting with a rear surface of the intermediate transfer element and (ii) the nip forming member.

9. The transfer device according to claim 8, wherein the voltage output device is configured to output, as the voltage, a voltage satisfying a relation of '$f>(4/d)\times v$', where a frequency of the AC component is f [Hz], a nip width is d [mm], and a surface movement velocity of the image carrier or the intermediate transfer element is v [mm/s], the nip width being a contact length of an image carrier and the nip forming member in a surface movement direction of the image carrier at the transfer nip.

10. An image forming apparatus comprising a transfer device according to claim 6, wherein the transfer device transfers the toner image carried on the surface of the image carrier or a latent image carrier to the recording material inserted into the transfer nip formed by contact of the image carrier and the nip forming member, or a transfer nip formed by contact of the latent image carrier and the nip forming member.

11. A transfer method comprising:

forming a transfer nip between a nip forming member and an image carrier by bringing the nip forming member into contact with a front surface of the image carrier, the front surface carrying a toner image; and transferring the toner image carried on the image carrier to a recording material at a position of the transfer nip by applying a transfer bias, wherein the transfer bias applied at the transferring is a transfer bias in which an AC component and a DC component are superimposed and in which a peak-to-peak voltage of the AC component is larger than 6 times an absolute value of a voltage of the DC component and smaller than 9 times the absolute value of the voltage of the DC component.

12. The transfer device according to claim 1, wherein the absolute value of the voltage of the AC component is larger than 6 [kV].

13. The transfer device according to claim 1, wherein a frequency of the AC component is equal to or greater than 200 [Hz].

14. The transfer device according to claim 13, wherein a frequency of the AC component is equal to or less than 700 [Hz].

15. The transfer device according to claim 1, wherein the nip forming member is a transfer roller including a rubber layer.

16. The transfer device according to claim 15, wherein the rubber layer is a NBR-based rubber layer.

17. The transfer device according to claim 1, wherein the nip forming member is a transfer roller, and a resistance of the transfer roller is $1 \times 10^6 \Omega$ or less.

18. The transfer device according to claim 1, further comprising a rear surface roller, wherein the image carrier is a belt that is wound around the rear surface roller at the transfer nip.

19. The transfer device according to claim 18, wherein a resistance of the rear surface roller is $1 \times 10^6 \Omega$ to $1 \times 10^{12} \Omega$.

20. The transfer device according to claim 18, wherein the rear surface roller includes a rubber layer.

21. The transfer device according to claim 18, wherein a thickness of the belt is 20 μm to 200 μm.

22. The transfer device according to claim 18, wherein a volume resistivity of the belt is $1 \times 10^6 \Omega \cdot cm$ to $1 \times 10^{12} \Omega \cdot cm$.

23. The transfer device according to claim 18, wherein the belt is composed of a carbon-dispersed polyimide resin.

24. The transfer device according to claim 1, wherein the toner image is formed by developing a grinded toner.

25. The transfer device according to claim 1, wherein the toner image is formed by developing a polyester-based toner.

26. A transfer device comprising:

an image carrier to carry a toner image;

a nip forming member that forms a transfer nip between the nip forming member and the image carrier by contacting with a front surface of the image carrier; and a transfer bias applicator that applies a transfer bias, thereby transferring the toner image carried on the image carrier to a recording material at a position of the transfer nip, wherein the transfer bias applicator applies the transfer bias in which an AC component and a DC component are superimposed and in which a peak-to-peak voltage of the AC component is larger than 4 times an absolute value of a voltage of the DC component, and a maximum depth of roughness of the recording material is equal to or greater than 81.76 μm.

27. A transfer device comprising:

an image carrier to carry a toner image;

a nip forming member that forms a transfer nip between the nip forming member and the image carrier by contacting with a front surface of the image carrier; and a transfer bias applicator that applies a transfer bias, thereby transferring the toner image carried on the image carrier to a recording sheet at a position of the transfer nip, wherein the transfer bias applicator applies the transfer bias in which an AC component and a DC component are superimposed, so that an amount of reciprocating toner particles of the toner image at the transfer nip increases as a number of times of reciprocation of the toner particles increases.

28. A transfer device comprising:

an image carrier to carry a toner image;

a nip forming member that forms a transfer nip between the nip forming member and the image carrier by contacting with a front surface of the image carrier; and a transfer bias applicator that applies a transfer bias, thereby transferring the toner image carried on the image carrier to a recording sheet at a position of the transfer nip, wherein, when the recording sheet is a first recording sheet, the transfer bias applicator applies a first transfer bias in which an AC component and a DC component are superimposed, so that an amount of reciprocating toner particles of the toner image at the transfer nip increases as a number of times of reciprocation of the toner particles increases, and when the recording sheet is a second recording sheet having a lower surface roughness than that of the first recording sheet, the transfer bias applicator applies a second transfer bias composed only of the DC component.

29. The transfer device according to claim 12, wherein the absolute value of the voltage of the AC component is smaller than 9 [kV].

30. The transfer device according to claim 1, further comprising a photosensitive drum on which the toner image is formed, wherein the image carrier is an intermediate transfer belt on which the toner image is transferred from the photosensitive drum.

31. The transfer device according to claim 1, further comprising a fixing unit to fix the toner image on the recording material.

32. The transfer device according to claim 27, wherein a peak-to-peak voltage of the AC component is larger than 6 times an absolute value of a voltage of the DC component.

33. The transfer device according to claim 32, wherein the peak-to-peak voltage of the AC component is smaller than 9 times the absolute value of the voltage of the DC component.

34. A transfer device comprising:

a photosensitive member;

an intermediate transfer member to carry a toner image, the toner image being transferred from the photosensitive member onto the intermediate transfer member;

a nip forming member that forms a transfer nip between the nip forming member and the intermediate transfer member by contacting with a front surface of the intermediate transfer member; and a transfer bias applicator that applies a transfer bias, thereby transferring the toner image carried on the intermediate transfer member to a recording material at a position of the transfer nip, wherein the transfer bias applicator applies the transfer bias in which an AC component and a DC component are superimposed and in which a peak-to-peak voltage of the AC component is larger than 6 times an absolute value of a voltage of the DC component and smaller than 9 times the absolute value of the voltage of the DC component.

* * * * *